US007705819B2

(12) United States Patent
Choi et al.

(10) Patent No.: US 7,705,819 B2
(45) Date of Patent: Apr. 27, 2010

(54) DISPLAY DEVICE

(75) Inventors: Jin-Young Choi, Seoul (KR); Jin Jeon, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 674 days.

(21) Appl. No.: 11/708,094

(22) Filed: Feb. 16, 2007

(65) Prior Publication Data

US 2007/0195049 A1 Aug. 23, 2007

(30) Foreign Application Priority Data

Feb. 20, 2006 (KR) ..... 10-2006-0016270

(51) Int. Cl.
*G09G 3/36* (2006.01)

(52) U.S. Cl. ..... 345/98; 345/100

(58) Field of Classification Search ..... 345/98–100
See application file for complete search history.

(56) References Cited

U.S. PATENT DOCUMENTS

| | | | | |
|---|---|---|---|---|
| 5,434,899 | A | 7/1995 | Huq et al. | |
| 6,556,646 | B1 * | 4/2003 | Yeo et al. | 377/54 |
| 6,801,194 | B2 | 10/2004 | Miyazawa et al. | |
| 6,963,327 | B2 | 11/2005 | Kawahata et al. | |
| 7,038,643 | B2 * | 5/2006 | Park | 345/87 |
| 2005/0156858 | A1 * | 7/2005 | Ahn et al. | 345/100 |
| 2005/0212746 | A1 | 9/2005 | Iwasaki et al. | |

FOREIGN PATENT DOCUMENTS

| | | |
|---|---|---|
| JP | 2002-311879 | 10/2002 |
| JP | 2002-328643 | 11/2002 |
| JP | 2003-179479 | 6/2003 |
| JP | 2005-62216 | 3/2005 |
| JP | 2005-123864 | 5/2005 |
| JP | 2005-196158 | 7/2005 |
| JP | 2005-285168 | 10/2005 |
| KR | 2002-0066962 | 8/2002 |
| KR | 10-0426910 | 10/2002 |

(Continued)

OTHER PUBLICATIONS

Patent Abstracts of Japan, Publication No. 2002-311879, Oct. 25, 2002, 1 p.

(Continued)

*Primary Examiner*—Richard Hjerpe
*Assistant Examiner*—Priyank Shah
(74) *Attorney, Agent, or Firm*—Innovation Counsel LLP

(57) ABSTRACT

A display device includes gate lines, data lines, storage electrode lines and pixels. Each pixel includes a switching element connected to a gate line and a data line, a liquid crystal capacitor connected to the switching element and a common voltage, and a storage capacitor connected to the switching element and a storage electrode line. Signal generating circuits of the display generate storage signals based on gate signals in such a way that the storage signal applied to each pixel has a changed voltage level immediately after the completion of the charging of the data voltage into the liquid crystal capacitor and the storage capacitor. This enables the pixel electrode to reach the target voltage in a single frame, reduces the power consumption of the display, and improves its response time, reliability and durability.

20 Claims, 13 Drawing Sheets

FOREIGN PATENT DOCUMENTS

KR 2005-0070554 7/2005

OTHER PUBLICATIONS

Patent Abstracts of Japan, Publication No. 2002-328643, Nov. 15, 2002, 1 p.
Patent Abstracts of Japan, Publication No. 2003-179479, Jun. 27, 2003, 1 p.
Patent Abstracts of Japan, Publication No. 2005-062216, Mar. 10, 2005, 1 p.
Patent Abstracts of Japan, Publication No. 2005-123864, May 12, 2005, 1 p.
Patent Abstracts of Japan, Publication No. 2005-196158, Jul. 21, 2005, 1 p.
Patent Abstracts of Japan, Publication No. 2005-285168, Oct. 13, 2005, 1 p.
Korean Patent Abstracts, Publication No. 1020020066962, Aug. 21, 2002, 2 pp.
Korean Patent Abstracts, Publication No. 1020020079585, Oct. 19, 2002, 1 p.
Korean Patent Abstracts, Publication No. 1020050070554, Jul. 7, 2005, 2 pp.

* cited by examiner

DISPLAY DEVICE

RELATED APPLICATION

This application claims priority of Korean Patent Application No. 10-2006-0016270, filed Feb. 20, 2006, the entire disclosure of which is incorporated herein by reference.

BACKGROUND

This present invention relates to display devices, such as liquid crystal displays (LCDs) s.

In general, an LCD includes two display panels having pixel electrodes and a common electrode, and a layer of a liquid crystal material having dielectric anisotropy interposed therebetween. The pixel electrodes are arranged in a matrix and connected to switching devices, such as thin film transistors (TFTs), which sequentially apply data voltages to them on a row-by-row basis. The common electrode is disposed over the entire surface of the display panel and has a common voltage applied it. The pixel electrode, the common electrode, and the liquid crystal layer interposed therebetween constitute a liquid crystal capacitor. The liquid crystal capacitor, together with the switching element connected thereto, defines a single pixel unit.

The LCDs images by applying an electric field to the liquid crystal layer disposed between the two panels and adjusting the transmittance of light passing through the liquid crystal layer by controlling the strength of the electric field acting on the liquid crystal layer. However, if a one-directional electric field is applied to the liquid crystal layer for a relatively long period of time, image degradation will occur. To prevent this, the polarities of the data voltages with respect to the common voltage are inverted in units of either a frame of pixels, a row of pixels, or a single pixel.

However, since the response speed of the liquid crystal molecules is relatively low, it takes some period of time for a voltage (hereinafter, referred to as a pixel voltage) charged in the liquid crystal capacitor to reach a target voltage, that is, a voltage which produces the desired luminance in the pixel. The time depends on the difference between the target voltage and the voltage to which the liquid crystal capacitor was previously charged. Therefore, where the difference between the target voltage and the previously-charged voltage is large, if only the target voltage is initially applied, the pixel voltage may not reach the full target voltage during the time in which the pixel switching element is turned on.

In order to address this problem, a DCC (dynamic capacitance compensation) scheme has been proposed. The DCC scheme makes use of the fact that the charging speed is proportional to the voltage across the liquid crystal capacitor. The data voltage (actually, the difference between the data voltage and the common voltage, but for convenience of description, the common voltage is assumed here to be 0V) applied to the pixel is designed to be higher than the target voltage so as to shorten the time taken for the pixel voltage to reach the target voltage.

However, the DCC scheme requires frame memories and driving circuits for performing the DCC calculations. The requirement for these elements creates problems in terms of circuit complexity and a concomitant increase in production costs.

In the case of medium-sized or small-sized LCDs, such as mobile phones, a "row inversion" technique is employed, in which the polarities of the data voltages with respect to the common voltage are inverted in units of pixel rows, so as to reduce power consumption. However, because the resolution of medium-sized or small-sized LCDs is gradually increasing, the power consumption problem is also increasing. In particular, when the DCC calculations are performed, the power consumption of the LCD is greatly increased, due to the additional calculation circuits required.

In addition, in the row inversion technique, the range of data voltages for image display is relatively small in comparison with a "dot inversion" technique, in which the polarities of the data voltages with respect to the common voltage are inverted in units of a pixel. Therefore, in a "VA" (vertical alignment) mode LCD, if a threshold voltage for driving the liquid crystal is high, the range of the data voltage used to represent grays for image display is reduced by the value of the threshold voltage. As a result, the desired luminance cannot be obtained.

BRIEF SUMMARY

In accordance with the exemplary embodiments thereof described herein, the present invention provides a driving apparatus for a display device that reduces the power consumption of the display device, and improves its response speed, reliability and durability.

In one exemplary embodiment, a display device configured to display images in a plurality of frames includes a plurality of gate lines adapted to transmit a plurality of gate signals, a plurality of data lines adapted to transmit a plurality of data voltages, a plurality of storage electrode lines adapted to transmit a plurality of storage signals, a plurality of pixels arranged in a matrix having a plurality of rows, wherein each pixel having a switching element connected to one of the gate lines and one of the data lines, a liquid crystal capacitor connected to the switching element and a common voltage, and a storage capacitor connected to the switching element and one of the storage electrode lines, and a plurality of signal generating circuits connected to the storage electrode lines, wherein each of the signal generating circuits is adapted to apply a storage signal having a first or second voltage to an associated one of the storage electrode lines in response to a gate-on voltage of a first gate signal and a first control signal immediately after the liquid capacitors and storage capacitors of an associated row of pixels have been charged by the data voltages, adapted to maintain the voltage of the storage signal for a predetermined time period in response to a gate-on voltage of a second gate signal and second and third control signals, and adapted to maintain the voltage of the storage signal in alternatively response to one of the second control signal and the third control signal every a predetermined period after the second gate signal outputs a gate-off voltage.

The storage signals that are applied to adjacent storage electrode lines may have different voltage levels from each other. The storage signal applied to the same storage electrode line may have a voltage level that is inverted every display frame. The common voltage may be a fixed voltage. The predetermined period may be about one horizontal period (1H).

In the exemplary embodiment above, the waveform of the first control signal may be the same as that of the third control signal. In addition, the waveform of the second control signal may be opposite to that of the third control signal. Each of the first to the third control signals may has a first voltage level and a second voltage level higher than the first voltage level, and alternate between the first and second voltage levels during a time period of about 1H.

An application time between the gate-on voltage of the first gate signal and the gate-on voltage of the second gate signal may be about 1H difference.

Each of the signal generating circuits may include a first transistor having a control terminal connected to one of the gate lines, an input terminal connected to the first control signal, and an output terminal connected to one of the storage electrode lines.

Each of the signal generating circuits may further include a second transistor having a control terminal connected to the gate line and an input terminal connected to the second control signal, and a third transistor having a control terminal connected to the gate line and an input terminal connected to the third control signal.

Each of the signal generating circuits may further include a fourth transistor having a control terminal connected to another of the gate lines and an input terminal connected to the second control signal, and a fifth transistor having a control terminal connected to the another gate line and an input terminal connected to the third control signal.

Each of the signal generating circuits may further include: A first capacitor having a first terminal connected to an output terminal of the second transistor and the other terminal connected to the third control signal; a second capacitor having a first terminal connected to an output terminal of the third transistor and the other terminal connected to the second control signal; a sixth transistor having a control terminal connected to the first terminal of the first capacitor, an input terminal connected to the storage electrode line and an output terminal connected to the first driving voltage; a seventh transistor having a control terminal connected to the first terminal of the second capacitor, an input terminal connected to the second driving voltage, and, an output terminal connected to the storage electrode line.

Each of the signal generating circuits may further include: A third capacitor having a first terminal connected to an output terminal of the fourth transistor and another terminal connected to the third control signal; a fourth capacitor having a first terminal connected to an output terminal of the fifth transistor and the other terminal connected to the second control signal; an eighth transistor having a control terminal connected to the first terminal of the third capacitor, an input terminal connected to the second driving voltage, and an output terminal connected to the storage electrode line; and a ninth transistor having a control terminal connected to the first terminal of the fourth capacitor, an input terminal connected to the storage electrode line, and an output terminal connected to the first driving voltage.

The first driving voltage may be lower than the second driving voltage. The first driving voltage may be about 0V, and the second driving voltage may be about 5V.

The second level may be higher than the second driving voltage, and the second level may be about 15V.

The display device may further include: A fifth capacitor connected between the control terminal of the sixth transistor and the first driving voltage; a sixth capacitor connected between the control terminal of the seventh transistor and the second driving voltage; a seventh capacitor connected between the control terminal of the eighth transistor and the second driving voltage; and an eighth capacitor connected between the control terminal of the ninth transistor and the first driving voltage.

A better understanding of the above and many other features and advantages of the novel dual side displays and the methods for making them of the present invention may be obtained from a consideration of the detailed description of some exemplary embodiments thereof below, particularly if such consideration is made in conjunction with the appended drawings, wherein like reference numerals are used to identify like elements illustrated in one or more of the figures thereof.

DETAILED DESCRIPTION

Figure 1:
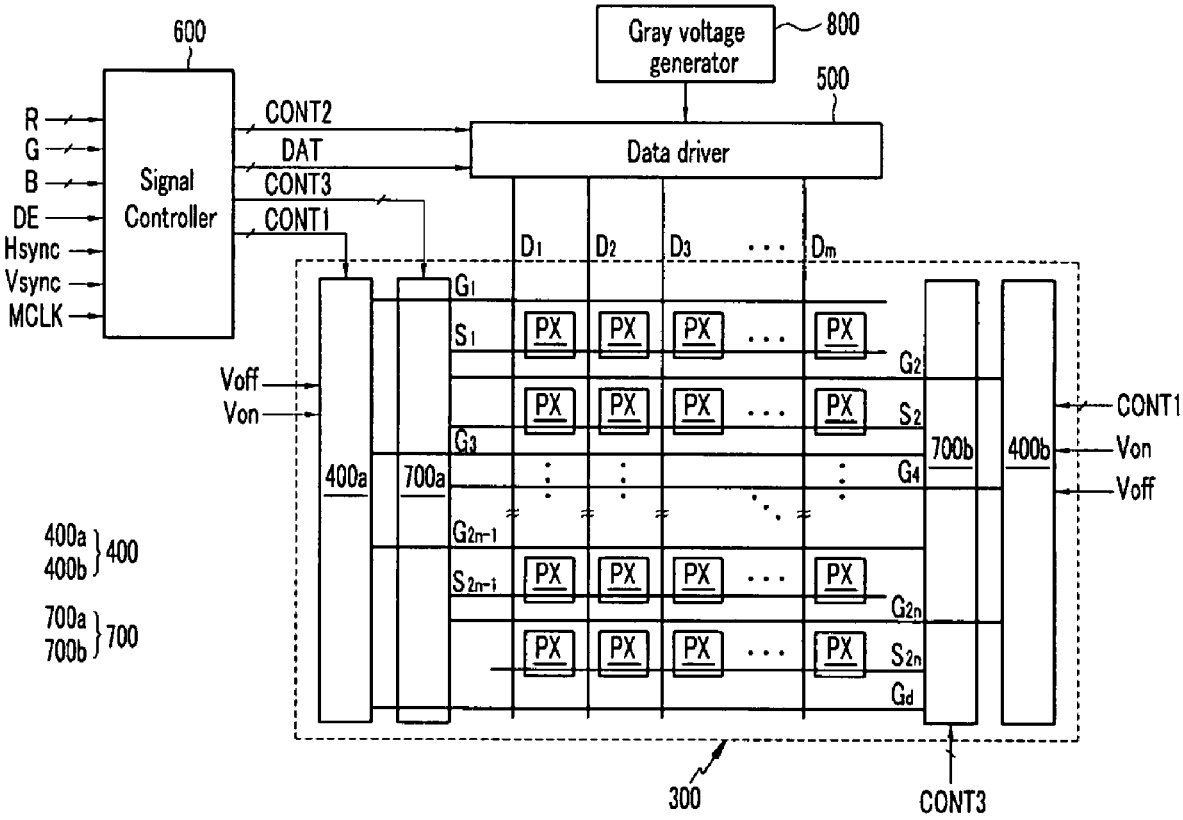
FIG. 1 is a functional block diagram of an exemplary embodiment of a liquid crystal display (LCD) in accordance with the present invention.
Figure 2:
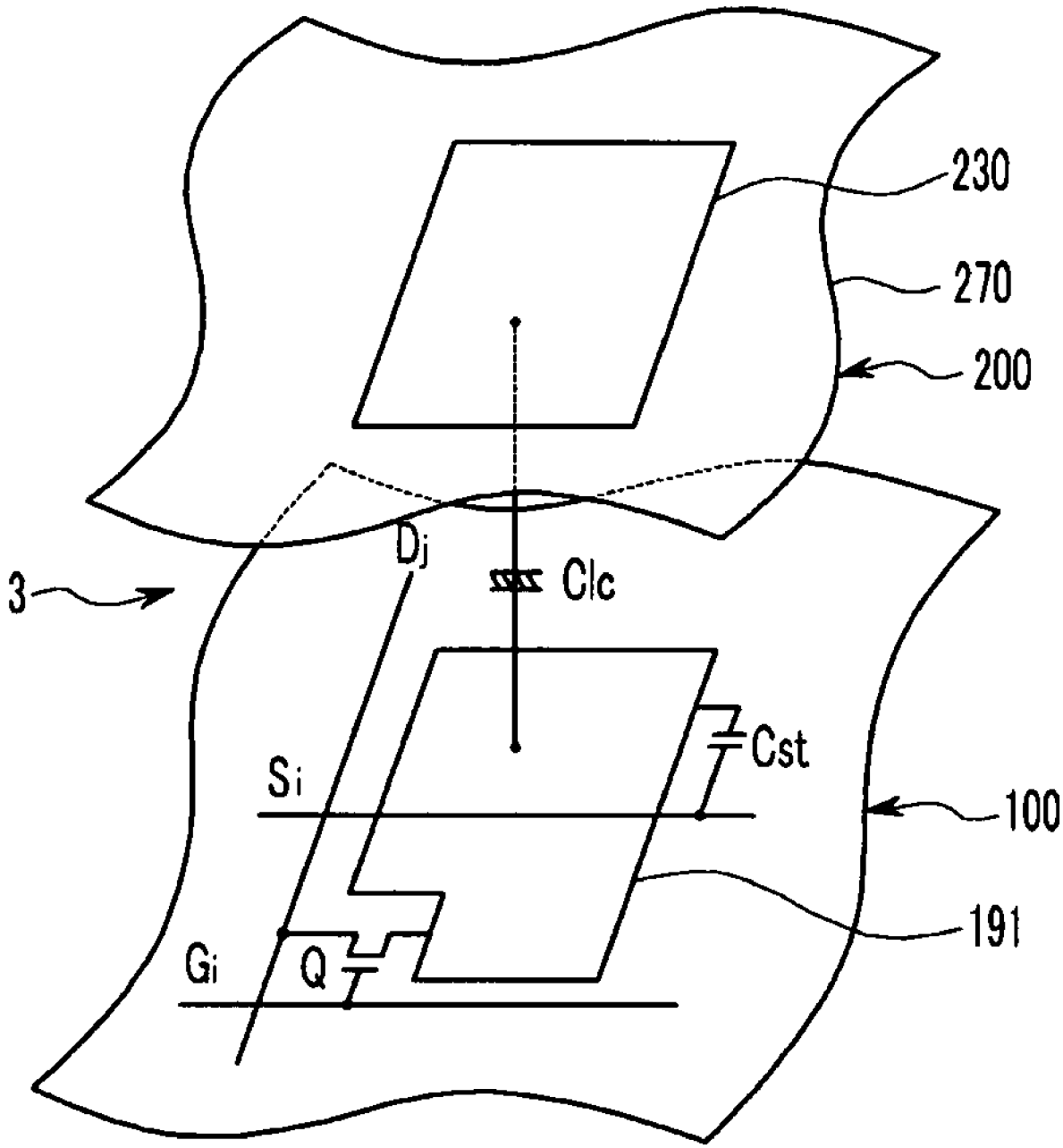
FIG. 2 is a partial perspective view of an equivalent circuit diagram of a single pixel of the exemplary LCD of FIG. 1.

An exemplary embodiment of an LCD in accordance with the present invention is described in detail below with reference to FIGS. 1 and 2, wherein FIG. 1 is a functional block diagram of the exemplary LCD and FIG. 2 is a partial perspective view of an equivalent circuit diagram of a single pixel of the exemplary LCD.

As illustrated in FIG. 1, the exemplary LCD includes a liquid crystal panel assembly 300, a gate driver 400, a data driver 500, a gray voltage generator 800 connected to the data driver 500, a storage signal generator 700, and a signal controller 600 that controls these components.

The liquid crystal panel assembly 300, in terms of an equivalent circuit thereof, includes a plurality of signal lines $G_1$-$G_{2n}$, $G_d$, $D_1$-$D_m$, and $S_1$-$S_{2n}$, and a plurality of pixels PX connected to the signal lines $G_1$-$G_{2n}$, $G_d$, $D_1$-$D_m$, and $S_1$-$S_{2n}$ and arranged substantially in the form of a rectangular matrix. In the schematic perspective structural view of FIG. 2, the liquid crystal panel assembly 300 includes lower and upper panels 100 and 200 facing each other and a layer of liquid crystal material 3 interposed between the two panels 100 and 200. The signal lines include a plurality of gate lines $G_1$-$G_{2n}$ and $G_d$, a plurality of data lines $D_1$-$D_m$, and a plurality of storage electrode lines $S_1$-$S_{2n}$.

The gate lines $G_1$-$G_{2n}$ and $G_d$ include a plurality of normal gate lines $G_1$-$G_{2n}$ and an additional gate line $G_d$, each of which transmits a gate signal (also referred to herein as a "scanning signal"). The storage electrode lines $S_1$-$S_{2n}$ are alternately connected to the normal gate lines $G_1$-$G_{2n}$ and transmit storage signals. Each of the data lines $D_1$-$D_m$, each of which transmits a respective data voltage.

The gate lines $G_1$-$G_{2n}$ and $G_d$ and the storage electrode lines $S_1$-$S_{2n}$ extend generally in a row direction, i.e., horizontally in the figures, and are substantially parallel to each other, while the data lines $D_1$-$D_m$ extend substantially in a column direction, i.e., vertically in the figures, and are substantially parallel to each other.

Referring to FIG. 2, each of the pixels PX, for example, a pixel PX connected to the i-th normal gate line $G_i$ (where i=1, 2, . . . , 2n) and the j-th data line $D_j$ (where j=1, 2, . . . , m) includes a switching element Q connected to the signal lines $G_i$ and $D_j$, and a liquid crystal capacitor Clc and a storage capacitor Cst that are connected to the switching element Q.

The switching element Q is a three-terminal element, such as a thin film transistor TFT, and is disposed on the lower panel 100. The switching element Q has a control terminal connected to the normal gate line $G_i$, an input terminal connected to the data line $D_j$, and an output terminal connected to the liquid crystal capacitor Clc and the storage capacitor Cst.

The liquid crystal capacitor Clc uses a pixel electrode 191 of the lower panel 100 and the common electrode 270 of the upper panel 200 as its two terminals, and the liquid crystal layer 3 interposed between the two electrodes 191 and 270 serves as the dielectric material thereof. The pixel electrode 191 is connected to the switching element Q, and the common electrode 270 is disposed on the entire surface of the upper panel 200 and supplied with a common voltage Vcom. The common voltage is a DC voltage having a specific magnitude.

In an alternative embodiment, and unlike that illustrated in FIG. 2, the common electrode 270 may be disposed on the lower panel 100, and in such a case, at least one of the two electrodes 191 and 270 may be formed in the shape of a line or a bar.

The storage capacitor Cst functions as an auxiliary of the liquid crystal capacitor Clc and is constructed by overlapping a pixel electrode 191 and a storage electrode lines $S_i$ with a dielectric insulator disposed between them.

To implement a color display, each of the pixels uniquely displays one of a set of primary colors ("spatial division"), or alternatively, each of the pixels alternately displays one of a set of the primary colors for a selected period of time ("temporal division"). A desired color can be obtained by either a spatial or a temporal combination of the primary colors. An example of primary colors is primary color set of red (R), green (G), and blue (B). FIG. 2 illustrates an example of spatial division. As shown in the figure, each of the pixels PX includes a color filter 230 for representing one of the primary colors, which is provided to a region of the upper panel 200 corresponding to the pixel electrode 191. In an alternative embodiment, and unlike that illustrated in FIG. 2, the color filter 230 may be provided above or below the pixel electrode 191 of the lower panel 100.

At least one polarizer (not illustrated) for polarizing light is attached on an outer surface of the liquid crystal panel assembly 300.

Referring to FIG. 1, the gray voltage generator 800 generates either a full set of gate voltages or a limited set of gray voltages (referred to as "reference gray voltages" herein) related to the light transmittance of the pixels PX. Some of the (reference) gray voltages have a positive polarity relative to the common voltage Vcom, while others of the (reference) gray voltages have a negative polarity relative to the common voltage Vcom.

The gate driver 400 includes first and second gate driving circuits 400*a* and 400*b* respectively arranged on opposite sides of the liquid crystal panel assembly 300, for example, right and left sides thereof. The first gate driving circuit 400*a* is connected to ends of the odd-numbered normal gate lines $G_1$, $G_3$, . . . , $G_{2n-1}$ and the additional gate line $G_d$, and the second gate driving circuit 400*b* is connected to ends of the even-numbered normal gate lines $G_2$, $G_4$, . . . , $G_{2n}$. However, in an alternative embodiment, the second gate driving circuit 400*b* may be connected to ends of the odd-numbered normal gate lines $G_1$, $G_3$, . . . , $G_{2n-1}$ and the additional gate line $G_d$, and the first gate driving circuit 400*a* may be connected to ends of the even-numbered normal gate lines $G_2$, $G_4$, . . . , $G_{2n}$.

The first and second gate driving circuits 400*a* and 400*b* synthesize a gate-on voltage Von and a gate-off voltage Voff for generating the gate signals and applying them to the gate lines $G_1$-$G_{2n}$ and $G_d$.

The gate driver 400 is integrated into the liquid crystal panel assembly 300 along with the signal lines $G_1$-$G_{2n}$, $G_d$, $D_1$-$D_m$, and $S_1$-$S_{2n}$ and the switching elements Q. However, the gate driver 400 may include at least one integrated circuit (IC) chip that is mounted directly on the LC panel assembly 300, or alternatively, on a flexible printed circuit (FPC) film in a tape carrier package (TCP) type, which is attached to the panel assembly 300. In yet another alternative embodiment, the gate driver 400 may be mounted on a separate printed circuit board (not illustrated).

The storage signal generator 700 includes first and second storage signal generating circuits 700*a* and 700*b* arranged, for example, on opposite sides of the liquid crystal panel assembly 300 and respectively adjacent to the first and second gate driving circuits 400*a* and 400*b*.

The first storage signal generating circuit 700*a* is connected to the odd-numbered storage electrode lines $S_1$, $S_3$, . . . , $S_{2n-1}$ and the even-numbered normal gate lines $G_2$, $G_4$, . . . , $G_{2n}$, and applies storage signals having a high level voltage and a low level voltage.

The second storage signal generating circuit 700*b* is connected to the even-numbered storage electrode lines $S_2$, $S_4$, . . . , $S_{2n}$ and the odd-numbered normal gate lines $G_3$, . . . , $G_{2n-1}$, except for the first normal gate line $G_1$ and the additional gate line $G_d$, and applies the storage signals to the storage electrode lines $S_2$, $S_4$, . . . , $S_{2n}$.

Instead of the storage signal generator 700 being supplied with the signal from the additional gate line $G_d$ connected to the gate driver 400, the storage signal generator 700 may be supplied with a signal from a separate unit, such as the signal controller 600 or a separate signal generator (not illustrated). In the latter embodiment, the additional gate line $G_d$ is not necessarily formed on the liquid crystal panel assembly 300.

The storage signal generator 700 is integrated into the liquid crystal panel assembly 300, along with the signal lines $G_1$-$G_{2n}$, $G_d$, $D_1$-$D_m$, and $S_1$-$S_{2n}$ and the switching elements Q. However, the storage signal generator 700 may include at least one integrated circuit (IC) chip mounted on the LC panel assembly 300, or on a flexible printed circuit (FPC) film in a tape carrier type of package (TCP), which are attached to the panel assembly 300. Alternatively, the storage signal generator 700 may be mounted on a separate printed circuit board (not illustrated).

The data driver 500 is connected to the data lines $D_1$-$D_m$ of the panel assembly 300 and applies data voltages, which are selected from the gray voltages supplied from the gray voltage generator 800, to the data lines $D_1$-$D_m$. However, when the gray voltage generator 800 generates only a few reference gray voltages, i.e., other than all of the gray voltages, the data driver 500 may divide the reference gray voltages to generate the data voltages from among the gray voltages that are generated. The signal controller 600 controls the gate driver 400, the data driver 500, and the storage signal generator 700. Each of driving devices 500, 600 and 800 may include at least one integrated circuit (IC) chip mounted on the LC panel assembly 300 or on a flexible printed circuit (FPC) film in a tape carrier type of package (TCP), which are attached to the panel assembly 300. Alternately, at least one of the driving devices 400, 500, 600 and 800 may be integrated into the panel assembly 300 along with the signal lines $G_1$-$G_{2n}$, $G_d$, $S_1$-$S_{2n}$, and $D_1$-$D_m$ and the switching elements Q. Alternatively, all the driving devices 400, 500, 600 and 800 may be integrated into a single IC chip, but at least one of the driving devices 400, 500, 600 and 800 or at least one circuit element in at least one of the processing units devices 400, 500, 600, and 800 may be disposed externally of the single IC chip.

In detail, operation of the liquid crystal display is as follows. The signal controller 600 receives input image signals R, G, and B and input control signals for controlling display thereof from an external graphics controller (not illustrated). The input image signals R, G and B contain luminance information of the pixels PX, and the luminance has a selected number of grays, for example 1024 ($=2^{10}$), 256 ($=2^8$), or 64 ($=2^6$) grays. Examples of the input control signals are a vertical synchronization signal Vsync, a horizontal synchronization signal Hsync, a main clock signal MCLK, and a data enable signal DE.

The signal controller 600 processes the image signals R, G, and B according to an operating condition of the liquid display panel assembly 300 based on the input control signals and the input image signals R, G, and B to generate gate control signals CONT1, data control signals CONT2, and storage control signals CONT3, and then transmits the gate control signals CONT1 to the gate driver 400, the data control signals CONT2 and the processed image signals DAT to the data driver 500, and the storage control signals CONT3 to the storage signal generator 700.

The gate control signals CONT1 include scanning start signals STV1 and STV2 for indicating scanning start, and at least one clock signal for controlling an output period of the gate-on voltage Von.

The gate control signals CONT1 may also include an output enable signal OE for defining the time of duration of the gate-on voltage Von.

The data control signals CONT2 include a horizontal synchronization start signal STH for indicating data transmission for a row of pixels PX, a load signal LOAD for commanding the application of data voltages to the data lines $D_1$ to $D_m$, and a data clock signal HCLK.

The data control signals CONT2 may further include an inversion signal RVS for inverting the polarity of the data voltages with respect to the common voltage Vcom.

In response to the data control signals CONT2 from the signal controller 600, the data driver 500 receives a packet of the digital image signals DAT for a row of the pixels PX, converts the digital image signals DAT to analog data voltages selected from the gray voltages, and applies the analog data voltages to the data lines $D_1$ to $D_m$.

The gate driver 400 applies the gate-on voltage Von to a corresponding one of the normal gate lines $G_1$-$G_{2n}$, for example, an i-th normal gate line $G_i$, in response to the gate control signals CONT1 from the signal controller, 600 and turns on the switching elements Q that are connected to the normal gate line $G_i$ (except for the additional gate line $G_d$ that is not connected to the switching elements Q). The data voltages applied to the data lines $D_1$-$D_m$ are then supplied to the pixels PX of the i-th row through the activated switching transistors Q such that the liquid crystal capacitor Clc and the storage capacitor Cst in the pixels PX are charged.

The difference between the voltage of the data voltage and the common voltage Vcom applied to a pixel PX is represented as a voltage across the liquid crystal capacitor Clc of the pixel PX, which is referred to as a pixel voltage. The liquid crystal molecules in the liquid crystal capacitor Clc have an orientation that depends on the magnitude of the pixel voltage, and the molecular orientations determine the polarization of light passing through the liquid crystal layer 3 associated with the respective pixels. The polarizer(s) converts light polarization to light transmittance such that the pixel PX has a luminance represented by a gray of the data voltage.

With the elapse of one horizontal period (also referred to as "1H" and equal to one period of the horizontal synchronization signal Hsync and the data enable signal DE), the data driver 500 applies data voltages to the pixels PX of a (i+1)-th row, and then the gate driver 400 changes the gate signal applied to the i-th normal gate line $G_i$ to a gate-off voltage Voff and changes the gate signal applied to the next normal gate line $G_{i+1}$ to a gate-on voltage Von. T switching elements Q of the i-th row are thereby turned off, such that pixel electrodes 191 are in a floating state.

The storage signal generator 700 changes the voltage level of the storage signal applied to i-th storage electrode line $S_i$ based on the storage control signals CONT3 and the voltage variation of the gate signal applied to the (i+1)-th gate line $G_{i+1}$. The voltage of the pixel electrode 191 connected to one terminal of the storage capacitor Cst is thereby varied in accordance with the voltage variation of the storage electrode line $S_i$ connected to another terminal of the storage capacitor Cst.

By repeating this procedure for all pixel rows, the liquid crystal display displays an image for one frame.

When the next frame starts after the one frame finishes, the inversion signal RVS applied to the data driver 500 is controlled such that the polarity of the data voltages is reversed (which is referred to as "frame inversion"). In addition, the polarity of the data voltages applied to the pixels PX of one row is substantially the same, and the polarity of the data voltages applied to pixels PX of the two adjacent rows is reversed (i.e., row inversion).

Since the exemplary LCD performs both frame inversion and row inversion, the polarity of all data voltages applied to the pixels PX of one row is positive or negative and is changed by a unit of one frame. At this point, a storage signal applied to a storage electrode line $S_1$-$S_{2n}$ is changed from a low level voltage to a high level voltage when the pixel electrode 191 is charged by a data voltage of a positive polarity. Conversely, the storage signal is changed from a high level voltage to a low level voltage when the pixel electrode 191 is charged by a data voltage of a negative polarity. As a result, the voltage of the pixel electrode 191 is increased more when the pixel electrode 191 is charged by a positive polarity data voltage and is decreased more when the pixel electrode 191 is charged by a negative polarity data voltage. Thus, the voltage range of the pixel electrode 191 is thereby made wider than the range of the gray voltages that are the basis of data voltages, such that the luminance range using a low basic voltage is thereby increased.

Figure 3:
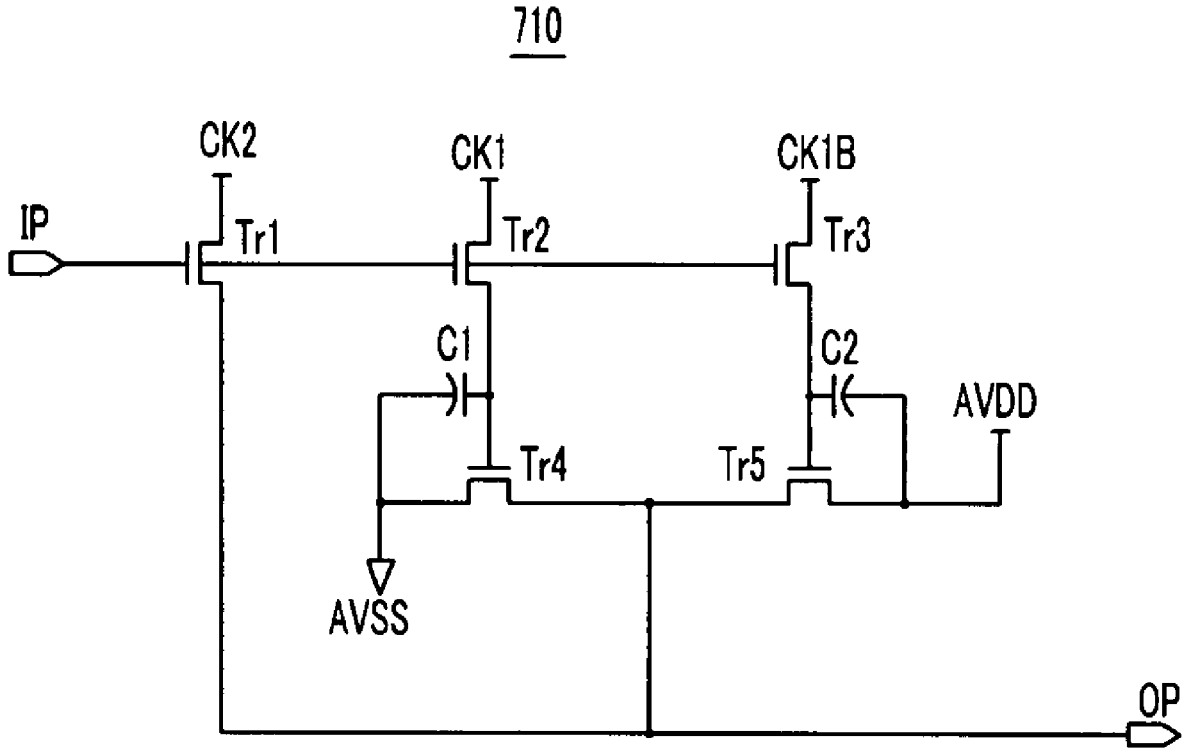
FIG. 3 is a circuit diagram of an exemplary embodiment of a signal generating circuit in accordance with the present invention.

The first and second storage signal generating circuits 700*a* and 700*b* may include a plurality of signal generating circuits 710 connected to the storage electrode lines $S_1$-$S_{2n}$, respectively. An exemplary embodiment of the signal generating circuits 710 in accordance with the present invention is described below with reference to FIGS. 3 and 4, wherein. FIG. 3 is a circuit diagram the exemplary signal generating circuit and FIG. 4 is a diagram illustrating the timing of the signals of the exemplary signal generating circuit.

Referring to FIG. 3, a signal generating circuit 710 includes an input terminal IP and an output terminal OP. In an i-th signal generating circuit, the input terminal IP is connected to an (i+1)-th gate line $G_{i+1}$ that is to be supplied with an (i+1)-th gate signal $g_{i+1}$ (hereinafter, "an input signal"), and the output terminal OP is connected to an i-th storage electrode line $S_i$ to output an i-th storage signal $Vs_i$. Similarly, in an (i+1)-th signal generating circuit, the input terminal IP is connected to an (i+2)-th gate line $G_{i+2}$ that is to be supplied with an (i+2)-th gate signal $g_{i+2}$ as an input signal, and the output terminal OP is connected to an (i+1)-th storage electrode line $S_{i+1}$ to output an (i+1)-th storage signal $Vs_{i+1}$.

The signal generating circuit 710 is supplied with first to third clock signals CK1, CK1B, and CK2 of the storage control signals CONT3 from the signal controller 600, and is further supplied with a high voltage AVDD and a low voltage AVSS from the signal controller 600 or another external device.

Figure 4:
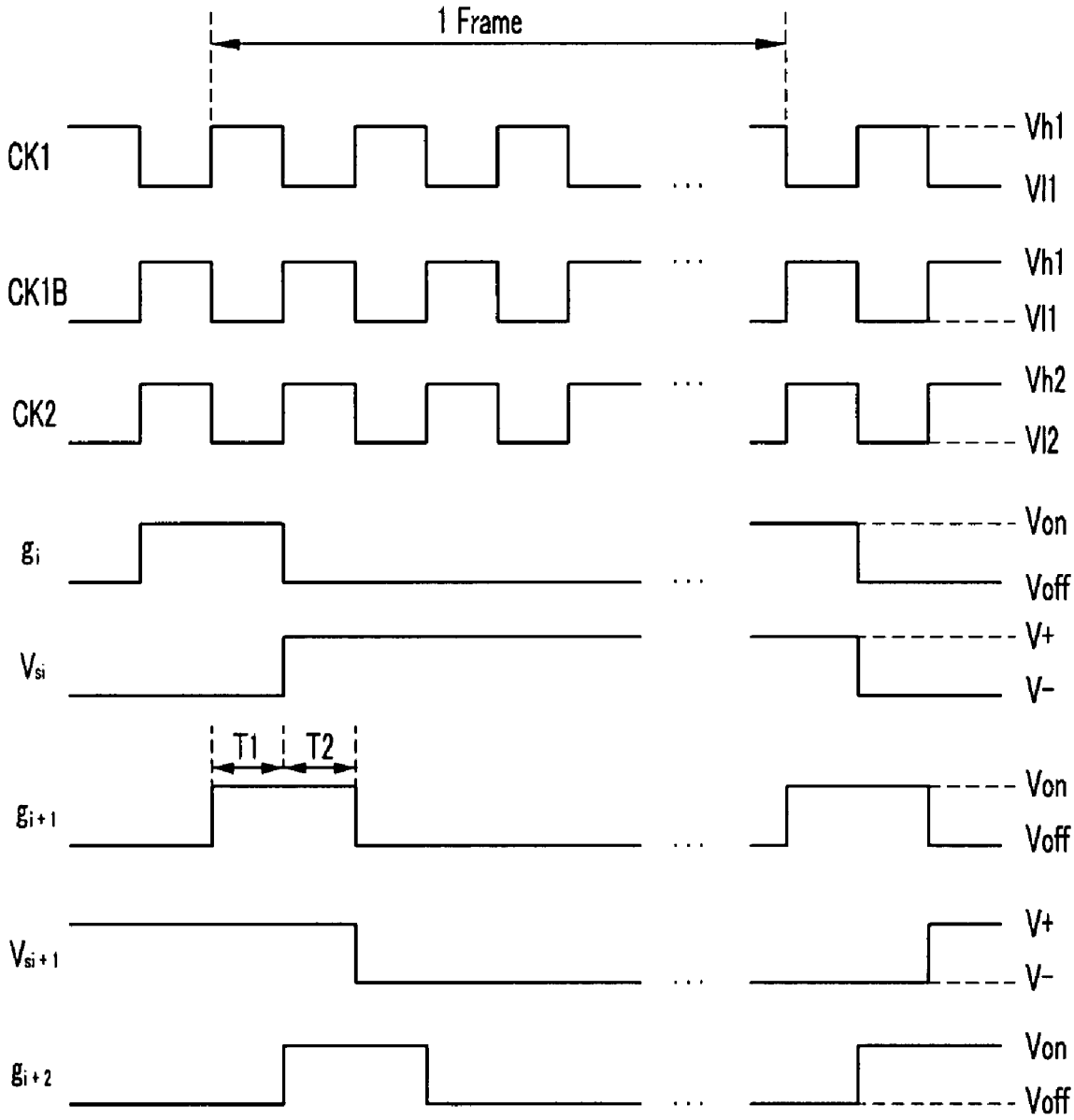
FIG. 4 is a diagram illustrating the timing of the signals of the signal generating circuit of FIG. 3.

As illustrated in FIG. 4, the period of the first to third clock signals CK1, CK1B, and CK2 may be about 2H, and a duty ratio thereof may be about 50%. The first and second clock signals CK1 and CK1B have a phase difference of about 180° and are inverted relative to each other, and the second clock signal CK1B and the third clock signal CK2 have substantially the same phase difference. In addition, the first to third clock signals CK1, CK1B, and CK2 are reversed by a unit of a frame.

The first and second clock signals CK1 and CK1B may have a high level voltage Vh1 of about 15V and a low level voltage Vl1 of about 0V. The third clock signal CK2 may have a high level voltage Vh2 of about 5V and a low level voltage V12 of about 0V. The high voltage AVDD may be about 5V, i.e., equal to the high level voltage Vh2 of the third clock signal CK2, and the low voltage AVSS may be about 0V, i.e., equal to the low level voltage V12 of the third clock signal CK2.

The signal generating circuit 710 includes five transistors Tr1-Tr5, each of which has a control terminal, an input terminal, and an output terminal and two capacitors C1 and C2.

The control terminal of the transistor Tr1 is connected to the input terminal IP, the input terminal of the transistor Tr1 is connected to the third clock signal CK2, and the output terminal of the transistor Tr1 is connected to the output terminal OP.

The control terminals of the transistors Tr2 and Tr3 are connected to the input terminal IP, and the input terminals of the transistors Tr2 and Tr3 are connected to the first and second clock signal CK1 and CK1B, respectively.

The control terminals of the transistors Tr4 and Tr5 are connected to the output terminals of the transistors Tr2 and Tr3, respectively, and the input terminals of the transistors Tr4 and Tr5 are connected to the low and high voltages AVSS and AVDD, respectively.

The capacitor C1 is connected between the control terminal of the transistors Tr4 and the low voltage AVSS, and the capacitor C2 is connected between the control terminal of Tr5 and the high voltage AVDD.

The transistors Tr1-Tr5 may be amorphous silicon transistors or polycrystalline silicon thin film transistors.

Operation of the signal generating circuit is as follows. As illustrated in FIG. 4, gate-on voltages Von applied to two adjacent gate lines overlap each other for some period of time, and the time of overlap of the gate-on voltages may be about 1H. As a result, all the pixels PX are charged with the data voltages that are applied to the pixels of the immediately previous row for a period of about 1H, and then are charged with new data voltages for the remaining 1H period for normal image display.

Operation of the i-th signal generating circuit is as follows. When an input signal, that is, a gate signal $g_{i+1}$ applied to a (i+1)-th gate line $G_{i+1}$, is changed into a gate-on voltage Von, the first to third transistors Tr1-Tr3 are turned on. The turned-on first transistor Tr1 transmits a third clock signal CK2 to the output terminal OP, and as a result, the voltage level of the storage signal $Vs_i$ becomes a low level voltage V− by a low level voltage V12 of the third clock signal CK2. Meanwhile, the turned-on transistor Tr2 transmits a first clock signal CK1 to the control terminal of the transistor Tr4, and the turned-on transistor Tr3 transmits a second clock signal CK1B to the control terminal of the transistor Tr5.

Since the first and second clock signals CK1 and CK1B are inverted relative to each other, the transistors Tr4 and Tr5 operate in reverse of each other. That is, when the transistor Tr4 is turned on, the transistor Tr5 is turned off, and conversely, when the transistor Tr4 is turned off, the transistor Tr5 is turned on. When transistor Tr4 is turned on and the transistor Tr5 is turned off, a low voltage AVSS is transmitted to the output terminal OP, and when transistor Tr4 is turned off and the transistor Tr5 is turned on, a high voltage AVDD is transmitted to the output terminal OP.

The period of the gate-on voltage Von of the gate signal $g_{i+1}$ is, for example, about 2H, and the first half of about 1H is denoted the first period T1 and the second half of the remaining period, about 1H, is denoted by the latter period T2.

Since, during the first period T1, the first clock signal CK1 remains at a high voltage Vh1, the second and third clock signals CK1B and CK2 remain at low voltages Vl1 and Vl2, respectively, and the output terminal OP, to which the low voltage V12 of third clock signal CK2 is transmitted by the transistor Tr1, is supplied with the low voltage AVSS. As a result, the storage signal $Vs_i$ is maintained at the low level voltage V−, which has a magnitude equal to those of the low voltage V12 and the low voltage AVSS. Meantime, during the first period T1, the voltage between the high level voltage Vh1 of the first clock signal CK1 and the low voltage AVSS is charged into the capacitor C1, and the voltage between the low level voltage Vl1 of the second clock signal CK1B and the high voltage AVDD is charged into the capacitor C2.

Since, during the latter period T2, the first clock signal CK1 remains at the low level voltage Vl1, and the second and third clock signals CK1B and CK2 remain at the high level voltages Vh1 and Vh2, the transistor Tr5 is turned on and the transistor Tr4 is turned off, i.e., opposite to their respective states during the first period T1.

As a result, the output terminal OP is supplied with the high level voltage Vh2 of the third clock signal CK2 transmitted through the turned on transistor Tr1, such that the state of the storage signal $Vs_i$ is changed from the low level voltage V− into a high level voltage V+ having a magnitude equal to that of the high level voltage Vh2. In addition, the output terminal Op is supplied with the high voltage VADD applied through the turned on transistor Tr5, which has a magnitude equal to that of the high level voltage V+.

Meanwhile, since the charged voltage into the capacitor C1 is substantially the same as the difference between the low level voltage V1 of the first clock signal CK1 and the low voltage VASS, the capacitor C1 is discharged when the low level voltage Vl1 of the first clock signal CK1 and the low voltage VASS are the same as each other. Since the voltage charged into the capacitor C2 is substantially the same as the difference between the high level voltage Vh1 of the second clock signal CK1B and the high voltage VADD, the charged voltage into the capacitor C2 is not 0V when the high level voltage Vh1 and the high voltage AVDD are different from each other. As described above, when the high level voltage Vh1 of the second clock signal CK1B is about 15V and the high voltage AVDD is about 5V, a voltage of about 10V is charged into the capacitor C2.

When the stage of the gate signal $g_{i+1}$ is changed from the gate-on voltage Von into the gate-off voltage Voff by the elapse of the latter period T2, the transistors Tr1-Tr3 are turned off. As a result, the output terminal of the transistor Tr1 is in an isolated state such that the electric connection between the transistor Tr1 and the output terminal OP is isolated. The output terminals of the transistors Tr2 and Tr3 are also in the isolated state such that the control terminals of the transistors Tr4 and Tr5 are also in the isolating state.

Since the voltage charged into the capacitor C1 does not yet exist, the transistor Tr4 is maintained in the turned-off state. However, the voltage between the high level Vh1 of the second clock signal CK1B and the high voltage AVDD has been charged into the capacitor C2. As a result, when the charged voltage is larger than a threshold voltage of the transistor Tr5, the transistor Tr5 remains in the turned-on state. As a result, the high voltage AVDD is transmitted to the output terminal OP to be output thereby as a storage signal $Vs_i$. Accordingly, the storage signal $Vs_i$ remains at the high level voltage V+.

The operation of the (i+1)-th signal generating circuit is as follows. When an (i+2)-th gate signal $g_{i+2}$ having a gate-on voltage Von is applied to the (i+1)-th signal generating circuit (not illustrated), the (i+1)-th signal generating circuit is activated.

As illustrated in FIG. 4, when the (i+2)-th gate signal $g_{i+2}$ is changed into the gate-on voltage Von, the states of the first to third clock signals CK1, CK1B, and CK2 are reversed relative to the case in which the (i+1)-th gate signal $g_{i+1}$ has a gate-on voltage Von.

That is, the operation for the first gate-on voltage period T1 of the (i+2)-the gate signal $g_{i+2}$ is the same as that of the second gate-on period T2 of the (i+1)-th gate signal $g_{i+1}$, such that the transistors Tr1, Tr3, and Tr5 are turned on. As a result, the high level voltage Vh2 of the third clock signal CK2 and the high voltage AVDD are applied to the output terminal OP, and the storage signal $Vs_{i+1}$ is thereby changed to the high level voltage V+.

However, the operation for the second gate-on voltage period T2 of the (i+2)-th gate signal $g_{i+2}$ is the same as that of the first gate-on period T1 of the (i+1)-th gate signal $g_{i+1}$, such that the transistors Tr1, Tr2, and Tr4 are all turned on. As a result, the low level voltage Vl2 of the third clock signal CK2 and the low voltage AVSS are applied to the output terminal OP, and the storage signal $Vs_{i+1}$ is thereby changed from the high level voltage V+ into the low voltage V−.

As described above, the transistor Tr1 is adapted to apply the third clock signal CK2 as a storage signal while the state of an input signal remains at the gate-on voltage Von, and the remaining transistors Tr2-Tr5 are adapted to maintain the state of the storage signal to the next frame using the capacitors C1 and C2 when the output terminal OP is isolated from the output terminal of the transistor Tr1 by the gate-off voltage Voff of the input signal. That is, the transistor Tr1 is for initially applying a storage signal to a corresponding storage electrode line, and the remaining transistors Tr2-Tr5 are for maintaining the outputted storage signal uniformly. Accordingly, it is preferable that the size of the transistor Tr1 be much larger than those of the transistors Tr2-Tr5.

As will be appreciated, the pixel electrode voltage Vp increases or decreases correspondingly to the voltage variation of the storage signal Vs. The change of the pixel electrode voltage Vp caused by voltage variation of the storage signal Vs is as described below.

Hereinafter, each of the capacitors and the respective capacitances thereof are denoted by the same reference characters. Firstly, the pixel electrode voltage Vp is obtained by Equation 1 below. In Equation 1, Clc and Cst represent a liquid crystal capacitor and a storage capacitor and the capacitance thereof, respectively, V+represents a high level voltage of a storage signal Vs, and V− represents a low level voltage of a storage signal Vs.

As illustrated in Equation 1, the pixel electrode voltage Vp is defined by adding or subtracting a variation amount Δ, which is defined by the capacitances Clc and Cst of the liquid crystal capacitor and the storage capacitor and the voltage variation of the storage signal Vs, from the data voltage VD.

$$Vp = V_D \pm \Delta = V_D \pm \frac{C_{st}}{C_{st} + c_{lc}}(V+ - V-) \quad \text{[Equation 1]}$$

The pixel is designed so that the data voltage $V_D$ is in a range of from about 0V to about 5V and the Cst and Clc are equal to each other. Thus, when V+−V−=5V, then Vp=VD±2.5 in Equation 1 above.

As a result, when the voltage of the storage signal Vs is changed, the pixel electrode voltage Vp increases or decreases by about ±2.5V from the data voltage $V_D$ applied thorough the associated data line according to the polarity of the data voltage $V_D$. Namely, when the polarity is positive, the pixel electrode voltage Vp increases by about +2.5V, and when the polarity is negative, the pixel electrode voltage VP decreases by about −2.5V. As a result of the change in the pixel electrode voltage Vp, the range of the pixel voltage is also widened. For example, when the common voltage Vcom is fixed to about 2.5V, the pixel voltage is disposed in a range of from about −2.5V to about +2.5V due to the data voltage $V_D$ ranging from about 0V to about 5V applied to the pixel voltage. However, when the storage signal Vs is changed from the high level voltage V+ to the low level voltage V−, the range of the pixel voltage is widened to a range of from about −5V to about +5V.

In this manner, the range of the pixel voltage is widened by a value of as much as the variation amount Δ of the pixel electrode voltage Vp caused by the change V+−V− in the storage signal. Therefore, the range of the voltage for representing the gray is widened, so that the luminance is thereby improved.

In addition, since the common voltage is fixed at a constant voltage, the power consumption is reduced in comparison with embodiments in which the high and lower voltages are alternately applied. That is, when the common voltage applied to the common electrode is about 0V or 5V, the voltage applied to a parasitic capacitor formed between the data line and the common electrode has a maximum of about ±5V. However, when the common voltage is fixed at about 2.5V, the voltage applied to the parasitic capacitor formed between the data line and the common electrode is reduced to a maximum of about ±2.5V. Since the power consumption in the parasitic capacitor formed between the data line and the common electrode is reduced, total power consumption in the liquid crystal display is also correspondingly reduced.

However, since the response speed of the liquid crystal layer is relatively low, the liquid crystal molecules do not respond rapidly to the pixel voltage. Therefore, the electrostatic capacitance of the liquid crystal capacitor Clc depends on the pixel voltage across the liquid crystal capacitor Clc and varies with whether or not the liquid crystal molecules reach the re-aligned and stabilized state. As a result, the pixel electrode voltage Vp varies with whether or not the liquid crystal molecules reach a stabilized state.

Following is a description of the change in the pixel electrode voltage Vp according to whether or not the liquid crystal molecules reach a stabilized state. The electrostatic capacitance of the liquid crystal capacitor Clc after a maximum pixel voltage, that is, a maximum gray (white gray in the normally black type) pixel voltage is applied to the liquid crystal capacitor Clc and after the liquid crystal molecules reach the stabilized state, is assumed to be three times the electrostatic capacitance of the liquid crystal capacitor Clc after a minimum pixel voltage, that is, a minimum gray (black gray in the normally black type) pixel voltage is applied to the liquid crystal capacitor Clc and after the liquid crystal molecules reach the stabilized state. In addition, it is assumed that V+−V−=5V and Clc=Cst.

The pixel electrode voltage Vp after the maximum gray pixel voltage is applied to the liquid crystal capacitor Clc when the liquid crystal molecules reach the stabilized state is represented by Equation 1. Since V+−V−=about 5V and Clc=Cst, the pixel electrode voltage Vp is Vp=VD±2.5.

However, in a case where after the maximum gray pixel voltage is applied to the liquid crystal capacitor Clc, the liquid crystal molecules do not reach the stabilized state. The pixel electrode voltage Vp is represented by Equation 2.

$$\begin{aligned} Vp &= V_D \pm \Delta \\ &= V_D \pm \frac{C_{st}}{C_{st} + c_{lc}}(V+ - V-) \\ &= V_D \pm \frac{C_{st}}{C_{st} + \frac{1}{3}C_{st}}(V+ - V-) \\ &= V_D \pm \frac{3}{4}(V+ - V-) \end{aligned} \quad \text{[Equation 2]}$$

$$\text{Since } V+ - V- = 5\text{ V}, \qquad V_p = V_D \pm 3.75.$$

Where, after the maximum gray pixel voltage is applied to the liquid crystal capacitor Clc, the liquid crystal molecules do not reach the stabilized state, the pixel electrode voltage Vp is sustained at the pixel electrode voltage after the minimum gray pixel voltage is applied to the liquid crystal capacitor Clc when the liquid crystal molecules do reach the stabilized state. That is, the pixel electrode voltage Vp is sustained in the state of the last frame. Therefore, the variation amount Δ of the pixel electrode voltage Vp caused by the change V+−V− of the storage signal increases from about +2.5V to about ±3.75V.

In the case of changing from the pixel electrode voltage of the minimum gray to the pixel electrode voltage of another gray, the variation amount Δ of the pixel electrode voltage Vp caused by the change V+−V− of the storage signal increase further until the liquid crystal molecules reach the stabilized state. When V+−V−=about 5V, the variation amount Δ increases to a maximum of about ±3.75V.

Figure 5:
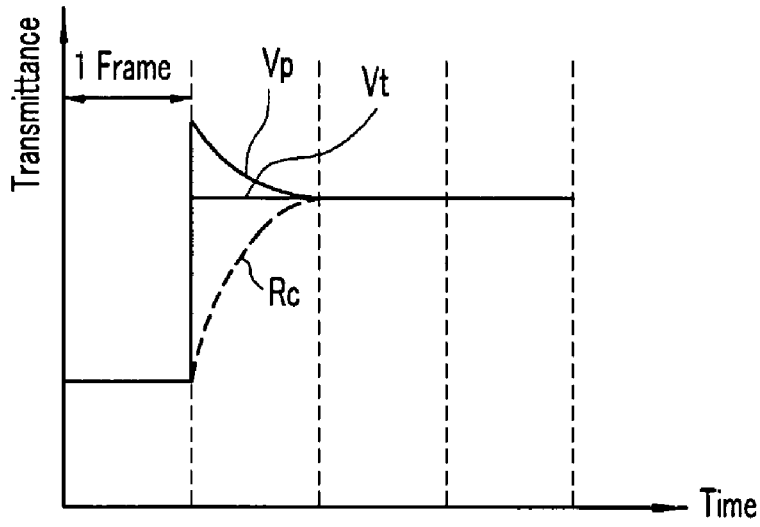
FIG. 5 is a graph illustrating the change in response speed of a liquid crystal layer and pixel electrode voltage during operation of the exemplary signal generating circuit of FIG. 3.
Figure 6:
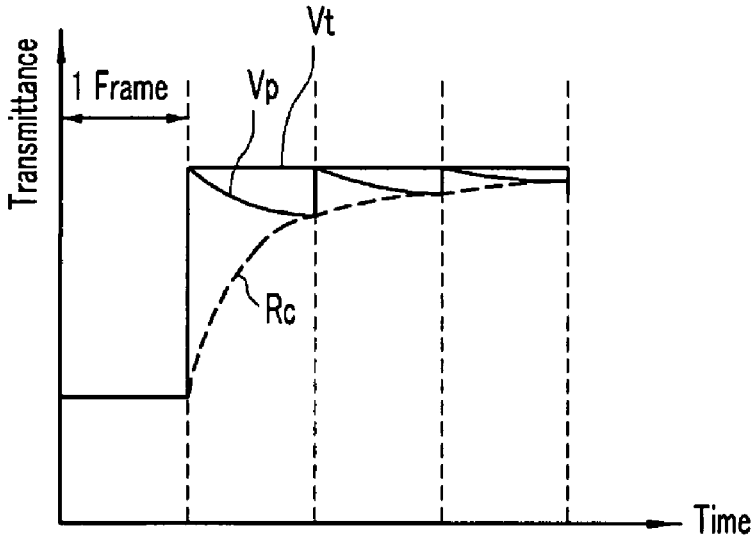
FIG. 6 (Prior Art)
FIG. 6 is a graph illustrating the change in response speed of a liquid crystal layer and pixel electrode voltage in a conventional LCD.

Therefore, in a convention display, as illustrated in FIG. 6, although the pixel electrode voltage Vp corresponding to the target pixel electrode voltage VT is applied to the pixel electrode in all of the frames, the pixel electrode voltage charged in the pixel electrode is reduced due to the influence of the adjacent data voltage after the completion of the charging operation so that it does not reach the target pixel electrode voltage VT in one frame. As a result, the pixel electrode voltage Vp reaches the target pixel electrode voltage VT only after several frames have been displayed. However, in accordance with the exemplary embodiment of the invention, as illustrated in FIG. 5, since the pixel electrode voltage Vp applied to the pixel electrode is higher than the target pixel electrode voltage VT, the pixel electrode reaches the target pixel electrode voltage VT in one frame. As a result, in comparison with a conventional display, the response speed RC of the liquid crystal is therefore substantially improved.

Accordingly, by adding the voltage variation of the storage signal Vs to or subtracting it from a data voltage $V_D$, the pixel electrode voltage Vp is increased by the voltage variation when the pixel has been charged with a data voltage of a positive polarity, and, conversely, the pixel electrode voltage Vp is decreased by the voltage variation when the pixel has been charged with a data voltage of a negative polarity. The variation of the pixel voltage is thereby made wider than the range of a gray voltage by the increased or decreased pixel electrode voltage Vp such that the range of the represented luminance also increases correspondingly.

Further, since the common voltage is fixed at a selected value, the power consumption is reduced as compared with a common voltage of alternating high and low values.

Figure 7:
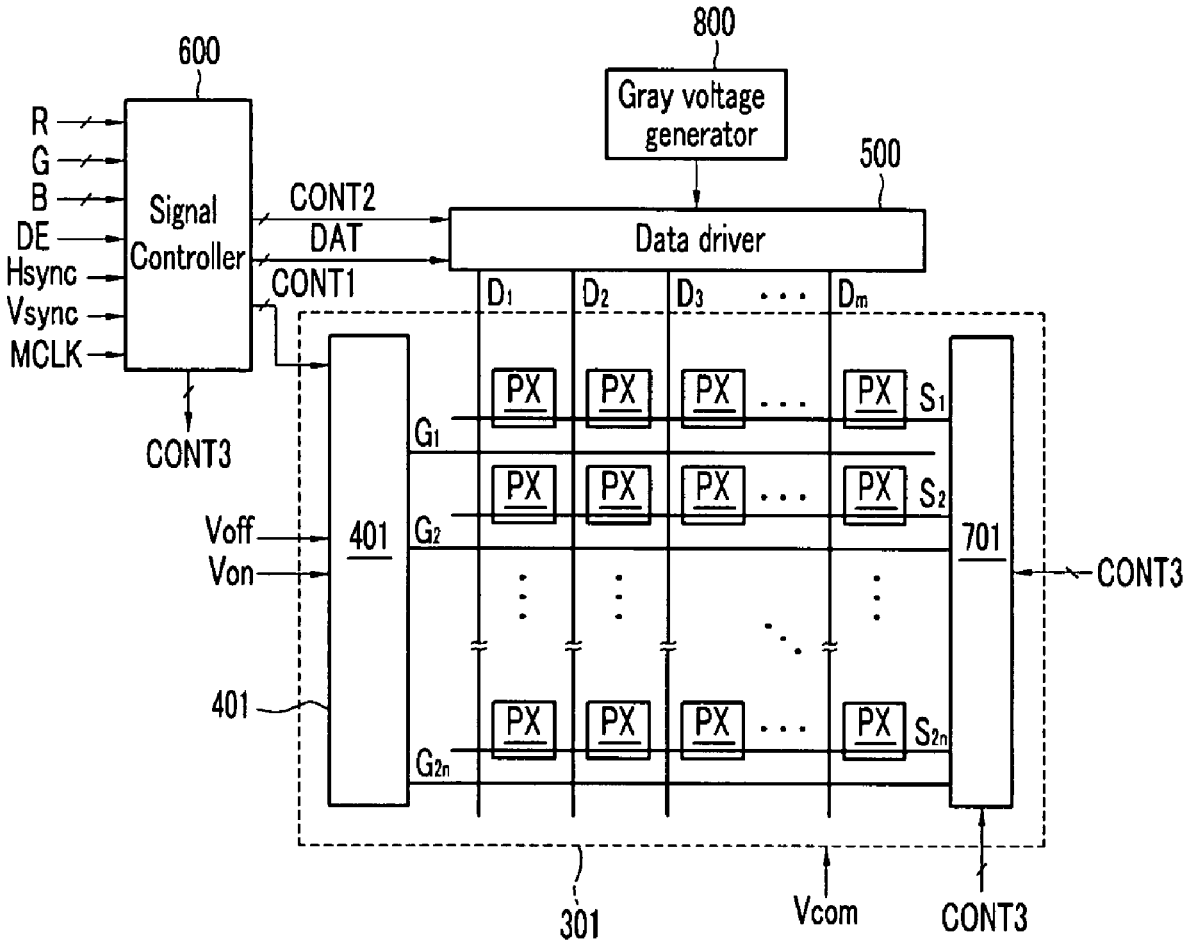
FIG. 7 is a functional block diagram of another exemplary embodiment of an LCD in accordance with the present invention.
Figure 8:
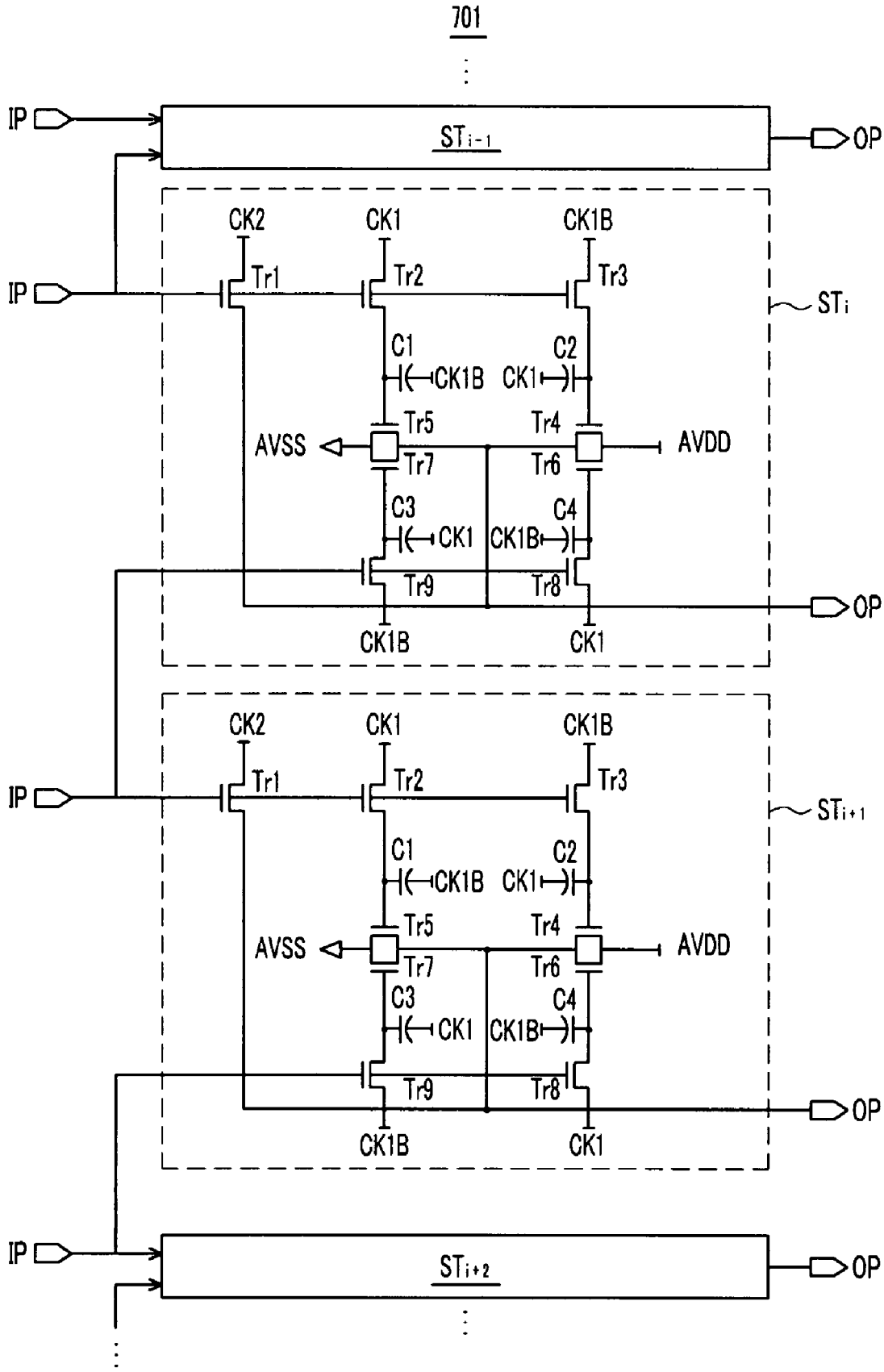
FIG. 8 is a circuit diagram of another exemplary embodiment of a signal generating circuit in accordance with the present invention.
Figure 9:
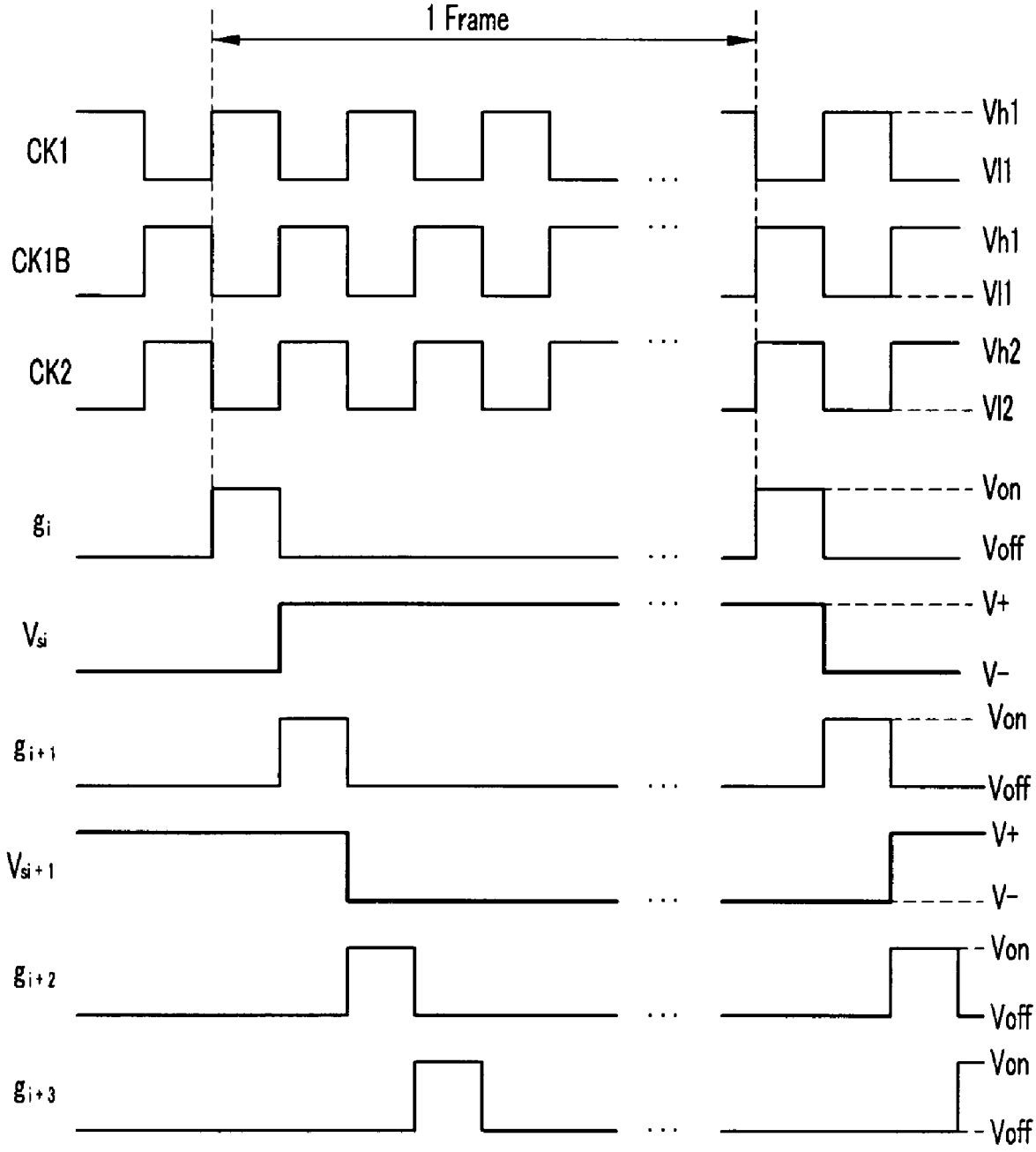
FIG. 9 is a diagram illustrating the timing of the signals of the signal generating circuit of FIG. 8.
Figure 10:
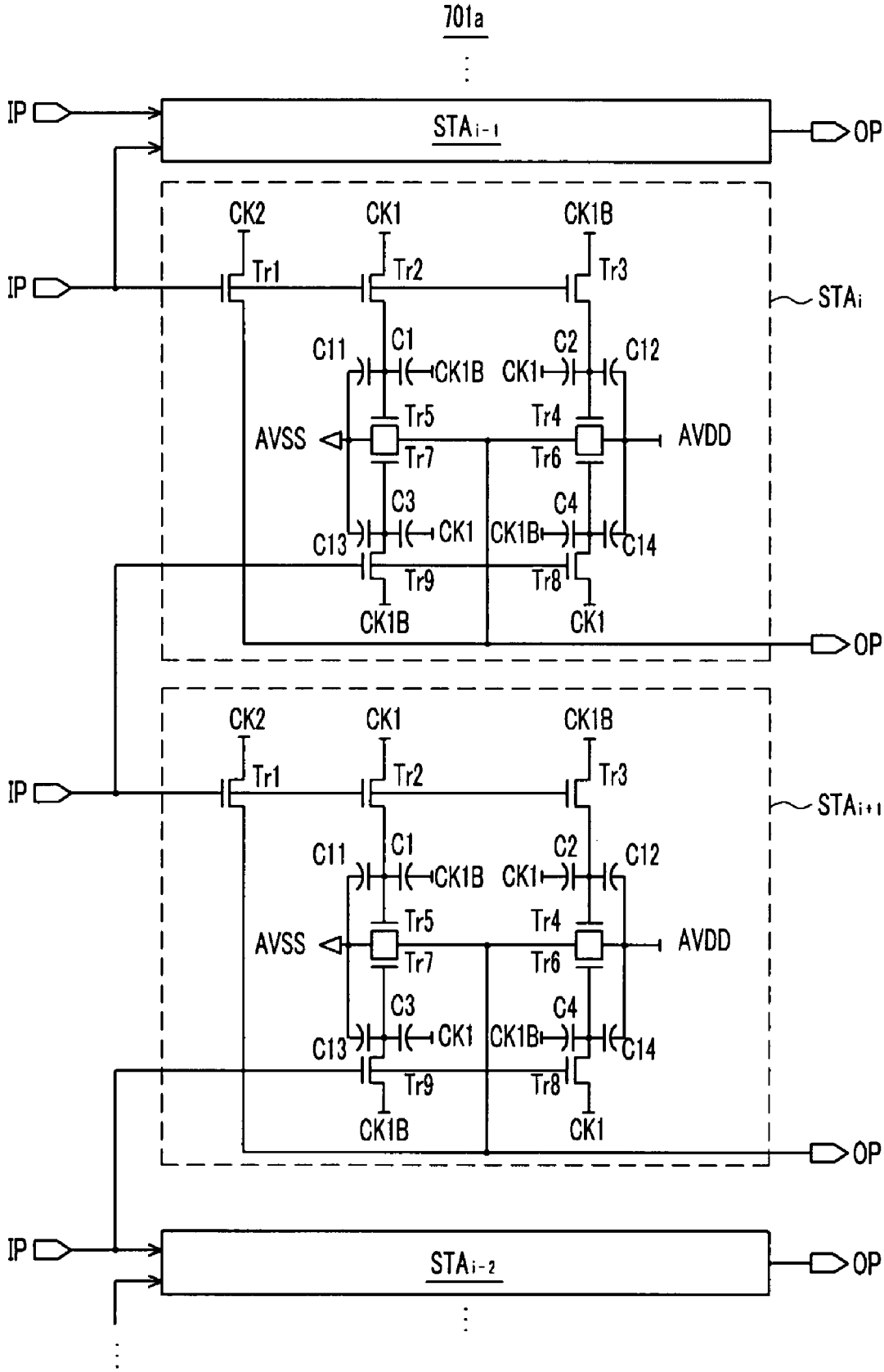
FIG. 10 is a circuit diagram of another exemplary embodiment of a signal generating circuit in accordance with the present invention.

A second exemplary embodiment of an LCD in accordance with the present invention is described below with reference to FIGS. 7 to 10, wherein FIG. 7 is a functional block diagram of the exemplary LCD, FIG. 8 is a circuit diagram of another exemplary embodiment of a signal generating circuit for use in the LCD, FIG. 9 is a diagram illustrating the timing of the signals of the signal generating circuit of FIG. 8, and FIG. 10 is a circuit diagram of another exemplary embodiment of a signal generating circuit in accordance with the present invention.

As illustrated in FIG. 7, the second exemplary LCD has substantially the same construction as that of the LCD of FIG. 1, except for a gate driver 401 connected to all the normal gate lines $G_1$ to $G_{2n}$ and a storage signal generator 701 connected to all the storage electrode lines $S_1$ to $S_{2n}$. Therefore, further detailed description of the like elements that are denoted by like reference numerals is omitted for brevity.

As was discussed in connection with FIG. 1 above, the gate driver 400 may be connected a selected number of additional gate lines (not illustrated) connected to the storage electrode line driver 701. The gate driver 401 and the storage signal generator 701 together with the switching elements Q of the pixels PX are formed and integrated with the same process into a liquid crystal panel assembly 301. Alternatively, the gate driver 401 and the storage signal generator 701 may be attached in a form of an IC chip mounted directly on the liquid crystal panel assembly 301, the gate driver 401 and the storage signal generator 701 may be mounted on a flexible printed circuit film (not illustrated) and attached in the form of a tape carrier package (TCP) on the liquid crystal panel assembly 301, or the gate driver 401 and the signal generator 700 may be mounted on a separate printed circuit board (PCB) (not illustrated).

The gate driver 401 sequentially applies the gate-on voltage Von to the normal gate lines $G_1$ to $G_{2n}$, starting from the first normal gate line $G_1$, to control the charging operation for the pixel row connected to the gate lines $G_1$ to $G_{2n}$ and the operation of the storage signal generator 701. Additionally, the gate driver 400 may apply the gate-on voltage Von to a predetermined number of dummy lines after the last gate line $G_{2n}$.

The storage signal generator 701 includes a plurality of signal generating circuits connected to the storage electrode lines $S_1$ to $S_{2n}$. The signal generating circuits have the same structure and perform the same operation except for the input signals. As illustrated in FIG. 8, a signal generating circuit, for example, an i-th signal generating circuit STi connected to an i-th storage electrode line $S_i$, and similar to the signal generating circuit shown in FIG. 3, includes five transistors Tr1 to Tr5 and two capacitors C1 and C2. However, the i-th signal generating circuit STi further includes four additional transistors Tr6 to Tr9 and two additional capacitors C3 and C4.

In a manner similar to the signal generating circuit shown in FIG. 3, the first transistors Tr1-Tr3 include input terminals connected to first to third clock signals CK1, CK1B, and CK2, respectively, control terminals connected to an input terminal IP, and output terminals connected to an output terminal OP and control terminals of the transistors Tr4 and Tr5, respectively. The transistors Tr4 and Tr5 include input terminals connected to a low voltage AVSS and a high voltage AVDD, respectively, and output terminals connected to the output terminal OP.

In addition, the transistors Tr6 and Tr7 include control terminals connected to input terminals of the transistors Tr8 and Tr9, respectively, input terminals connected to the high voltage AVDD and the low voltage AVDD, respectively, and output terminals connected to the output terminal OP. The transistors Tr8 and Tr9 have control terminals connected to an input terminal of the next signal generating circuit, that is, an (i+1)-th signal generating circuit STi+1, input terminals connected to control terminals of the transistors Tr6 and Tr7, respectively, and output terminals connected to the first and second clock signals CK1 and CK1B, respectively.

The capacitor C1 is connected between the control terminal of the transistor Tr4 and the second clock signal CK1B, and the capacitor C2 is connected between the control terminal of the transistor Tr5 and the first clock signal CK1.

The capacitor C3 is connected between the control terminal of the transistor Tr7 and the first clock signal CK1, and the capacitor C4 is connected between the control terminal of the transistor Tr6 and the second clock signal CK1B.

The transistors Tr1 to Tr9 may be amorphous silicon transistors or polycrystalline silicon thin film transistors and may be formed into the liquid crystal panel assembly. In such a construction, the signal generating circuit STi connected to the i-th storage electrode line $S_i$ is applied with the gate signals $g_{i+1}$ and $g_{i+2}$ applied to the (i+1)-th and (i+2)-th gate lines $G_{i+1}$ and $G_{i+2}$.

Therefore, as described above, in order to apply the gate signals to a selected number of the signal generating circuits, for example the (n−1)-th signal generating circuit and the n-th signal generating circuit, a selected number of additional gate lines (not illustrated) are needed. The additional gate lines are formed substantially parallel to the gate lines $G_1$ to $G_{2n}$ on the liquid crystal panel assembly 301 and connected to the gate driver 401 to be sequentially applied with gate signals constructed with a combination of the gate-on and gate-off voltages Von and Voff next to the gate signal $g_{2n}$.

Alternatively, the (n−1)-th signal generating circuit and the n-th signal generating circuit may be applied with an external control signal from other devices such as a signal controller 600 instead of the gate driver 401.

The operation of the signal generating circuit is described below with reference to the signal timing diagram of FIG. 9. Initially, it should be noted that, as in the first embodiment above, in the second exemplary display, one row inversion and a frame inversion are performed, and the first to third clock signals CK1, CK1B, and CK2 are the same as those of the clock signals CK1, CK1B, and CK2 shown in FIG. 4. As illustrated in FIG. 9, the gate-on voltages Von sequentially applied to the normal gate lines $G_1$ to $G_{2n}$ do not overlap the adjacent gate-on voltage Von.

Operation of the i-th signal generating circuit STi is as follows. When the gate-on voltage Von is applied to the gate signal $g_{i+1}$, the transistors Tr1 to Tr3 are turned on.

Therefore, as illustrated in FIG. 4, during the time when the transistor Tr1 is turned on, a high level voltage Vh2 of the third clock signal CK2 is output to storage voltage line $S_i$ as an storage signal $Vs_i$ through the output terminal OP, so that the storage signal $Vs_i$ is changed from the low level voltage V− to the high level voltage V+. During the application of the gate-on voltage Von to the gate signal $g_{i+1}$, the first clock signal CK1 is sustained at the low level voltage Vl1, and the second clock signal CK1B is sustained at the high level voltage Vh1. Therefore, the low level voltage Vl1 and the high level voltage Vh1 are applied through the turned-on transistors Tr2 and Tr3 to the control terminals of the transistors Tr4 and Tr5, respectively, so that the transistor Tr5 is turned on and the transistor Tr4 is turned off.

As a result, during the application of the gate-on voltage Von to the gate signal $g_{i+1}$, for example, during a period of about 1H, the high level voltage Vh2 of the third clock signal CK2 and the high voltage AVDD are applied to the output terminal OP, such that the storage signal $S_i$ is applied with the high level voltage V+.

After a period of about 1H, the gate-off voltage Voff is applied to the (i+1)-th gate signal $g_{i+1}$, and the gate-on voltage is applied to the (i+2)-th gate signal $g_{i+2}$, so that the transistors Tr1 to Tr3 are turned off, and the transistors Tr8 and Tr9 are turned on.

At this time, the first clock signal CK1 becomes the high level voltage Vh1, and the second clock signal CK1B becomes the low level voltage Vl1.

As a result, the first and second clock signals CK1 and CK1B are applied through the transistors Tr8 and Tr9, the transistor Tr6 is turned on, and the transistor Tr7 is turned off.

Since the first clock signal CK1 connected to the capacitor C2 is changed from the low level voltage Vl1 to the high level voltage Vh1, the control terminal of the transistor Tr5 connected to the capacitor C2 is changed to a voltage that is higher than the high level voltage Vh1 applied at the time the transistor Tr3 is turned on. Since the second clock signal CK1B connected to the capacitor C1 is changed from the high level voltage Vh1 to the low level voltage Vl1, the control terminal of the transistor Tr4 connected to the capacitor C1 is changed into a voltage that is lower than the low level voltage Vl1 applied at the time the second transistor Tr2 is turned on.

As a result, during the application of the gate-on voltage Von to the (i+2)-th gate signal $g_{i+2}$, the transistors Tr5 and Tr6 are turned on, so that the high voltage AVDD is output as a storage signal $Vs_i$ through the output terminal OP.

After a period of about 1H, the (i+2)-th gate signal $g_{i+2}$ is turned off, so that the transistors Tr8 and Tr9 are turned. The first clock signal CK1 is changed from the high level voltage Vh1 to the low level voltage Vl1, and the second control signal CK1B is changed from the low level voltage Vl1 to the high level voltage Vh1.

Therefore, the control terminal of the transistor Tr7 connected to the capacitor C3 is changed into a voltage that is lower than the low level voltage Vl1 applied at the time the transistor Tr9 is turned on. The control terminal of the transistor Tr6 connected to the capacitor C4 is changed into a voltage that is higher than the high level voltage Vh1 applied at the time the transistor Tr8 is turned on.

As a result, due to the charged voltage of the capacitor C4, the transistor T6 is turned on, so that the high voltage AVDD is output as a storage signal $Vs_i$ to the output terminal OP through the transistor T6, such that the storage signal $Vs_i$ has the high level voltage V+.

After a period of about 1H, the first control signal CK1 is changed from the low level voltage Vl1 to the high level voltage Vh1, and the second control signal CK1B is changed from the high level voltage Vh1 to the low level voltage Vl1. As a result, due to the operation of the capacitor C2 connected to the first clock signal CK1, the transistor Tr5 is turned on, so that the high voltage AVDD is output as a storage signal $Vs_i$ to the output terminal OP through the turned-on transistor Tr5. As a result, the storage signal $Vs_i$ has the high level voltage V+.

Therefore, when the (i+1)-th gate signal $g_{i+1}$ is applied with the gate-off voltage Voff, during the period of about 1H, when the first clock signal CK1 is sustained at the high level voltage Vh1, the transistor Tr5 is turned on due to the charged voltage of the capacitor C2 connected to the control terminal of the transistor Tr5, so that the high voltage AVDD is applied through the transistor Tr5 to the output terminal OP. During the period of about 1H when the second clock signal CK1B is sustained in the high level voltage Vh1, the transistor Tr6 is turned on due to the charged voltage of the capacitor C4 connected to the control terminal of the transistor Tr6, so that the high voltage AVDD is applied through the transistor Tr6 to the output terminal OP.

In the foregoing manner, the transistors Tr5 and Tr6 are alternately turned on according to the charging operation of the capacitors C2 and C4 in a period of about 1H. Therefore, until the gate-on voltage Von of the next frame is applied, the high voltage AVDD is output to the output terminal OP, and accordingly, a storage signal $Vs_i$ of the high level voltage V+ is output.

As a result, due to the application of the gate-on voltage Von, after the charging operation for the pixel row connected to the i-th gate line $G_i$, that is, the gate-on voltage Von is applied to the (i+1)-th gate line $G_{i+1}$, the storage signal $Vs_i$ is changed from the low level voltage V− to the high level voltage V+, so that the pixel electrode voltage is increased by the variation amount defined by Equation 1 or 2 above.

Accordingly, in a manner similar to the first LCD embodiment above, since the pixel electrode voltage applied to the pixel electrode is higher than the target pixel electrode voltage, the pixel electrode can reach the target pixel electrode voltage in one frame. Therefore, in comparison with the prior art, the response speed of the liquid crystal is substantially improved.

In addition, after the application of the gate-on voltage Von to the gate signal that is applied to the transistors Tr1 to Tr3, the transistors Tr5 and Tr6 are alternately turned on in a period of about 1H, so that the voltage state of the storage signal $Vs_i$ is sustained until the next frame. As a result, the reliability of operation of the transistors Tr5 and Tr6 is improved, so that the storage signal $Vs_i$ is supplied in a stable manner.

That is, in the case where the voltage state of the storage signal is sustained until the next frame by using only one of the transistors Tr5 and Tr6, the turning-on voltage needs to be applied to the control terminals of the transistors Tr5 and Tr6 until the next frame. In this case, the operational characteristics of the transistors are degraded, due to the long-time turning-on operation of the transistors, so that a change in the level of the threshold voltage or other deterioration in reliability of the operation of the transistor may occur. However, since the transistors Tr5 and Tr6 are alternately turned on in a period of about 1H, the stress exerted on the control terminals of the transistors Tr5 and Tr6 is reduced, so that the reliability of operation and durability of the transistors is increased.

As illustrated in FIG. 9, similar to the operation of the i-th signal generating circuit, when the (i+1)-th signal generating circuit STi+1 is applied with the (i+2)-th gate signal $g_{i+2}$, the transistors Tr1 to Tr3 are turned on. Therefore, during the application of the gate-on voltage Von through the transistor Tr1, the third clock signal CK2 having the low level voltage V12 is output as a storage signal $Vs_{i+1}$ through the output terminal OP, and accordingly, the storage signal Vsi+1 of the high level voltage V+ is output.

During a period of about 1H, when the (i+2)-th gate signal $g_{i+2}$ is applied with the gate-on voltage Von, the first clock signal CK1 is sustained at the high level voltage Vh1, and the second clock signal CK1B is sustained at the low level voltage Vl1. Therefore, the transistor Tr5 is turned off, and the transistor Tr4 is turned on. As a result, the low level voltage Vl1 and low voltage AVSS applied through the turned-on transistors Tr1 and Tr4 are applied to the output terminal OP, and as a result, the storage signal $Vs_{i+1}$ of the low level voltage V− is output.

After a period of about 1H, the (i+3)-th gate signal $g_{i+3}$ is applied with the gate-on voltage Von. Therefore, the first clock signal CK1 is sustained in the low level voltage Vl1, and the second clock signal CK1B is sustained in the high level voltage Vh1. As a result, the transistor Tr7 is turned on, and the transistor Tr4 is also turned on due to the charged voltage of the capacitor C1. Therefore, during the time when the (i+3)-th gate signal $g_{i+3}$ is applied with the gate-on voltage Von, the transistors Tr4 and Tr7 are turned on, so that the low voltage AVSS is output to the output terminal, and accordingly, the storage signal $Vs_{i+1}$ of the low level voltage V− is output.

After about 1H, the first clock signal CK1 is sustained at the high level voltage Vh1, and the second control signal CK1B is sustained at the low level voltage Vl1. Therefore, the transistor Tr7 is turned on due to the charged voltage of the capacitor C3, so that the low voltage AVSS is output as a storage signal $Vs_{i+1}$. As a result, the storage signal $Vs_{i+1}$ has the low voltage level V−.

In this manner, the transistor Tr4 or Tr7 is turned on due to the charging operation of the capacitor C1 or C3, and the low voltage AVSS is output in a period of about 1H as a storage signal $Vs_{i+1}$ until the gate-on voltage Von of the next frame is applied. That is, when the first clock signal CK1 is sustained at the high level voltage Vh1, the low voltage AVSS is output as a storage signal $Vs_{i+1}$ due to the operations of the capacitor C3 and the transistor Tr7. When the second clock signal CK1B is sustained at the high level voltage Vh1, the low voltage AVSS is output as a storage signal $Vs_{i+1}$ due to the operations of the capacitor C1 and the transistor Tr4.

As a result, due to the application of the gate-on voltage Von, after the charging operation for the pixel row connected to the (i+1)-th gate line $G_i$, that is, the gate-on voltage Von is applied to the (i+2)-the gate line $G_{i+2}$, the storage signal $Vs_{i+1}$ is changed from the high level voltage V+ to the low level voltage V−, so that the pixel electrode voltage is decreased by the variation amount defined by Equation 1 or 2 above. Accordingly, in a manner similar to the first exemplary LCD described above, since the pixel electrode voltage applied to the pixel electrode is higher than the target pixel electrode voltage, the pixel electrode can reach the target pixel electrode voltage in one frame. Therefore, in comparison with the prior art, the response speed of the liquid crystal is substantially improved.

Like the transistors Tr5 and Tr6 above, after the applying of the gate-on voltage Von to the gate signal applied to the transistors Tr1 to Tr3, the transistors Tr4 and Tr7 are alternately turned on in a period of about 1H, so that the voltage state of the storage signal $Vs_{i+1}$ is sustained until the next frame. As a result, reliability of operations of the transistors Tr4 and Tr7 is improved, and the storage signal $Vs_i$ is supplied in a stable manner.

In the foregoing manner, due to the operations of the respective signal generating circuit, the storage signals $Vs_1$, $Vs_2$, . . . $Vs_{2n}$ are applied from the first storage electrode line $S_1$ to the last storage electrode line $S_{2n}$.

As described above, the transistor Tr1 is used to initially apply the storage signal voltage to the corresponding storage electrode line, and the other transistors Tr2 to Tr9 are used to sustain the storage signal applied to the storage electrode line until the next frame. Therefore, it is preferable that the transistors Tr2 to Tr9 be smaller than the transistor Tr1.

Further, it should be understood that, although the second exemplary LCD embodiment is shown and described as including only one gate driver 401 and one storage signal generator 701, the present invention is not limited thereto. For example, the above signal generation circuit can be applied to the LCD of FIG. 1.

A third exemplary embodiment of a signal generator circuit in accordance with the present invention is described below with reference to FIG. 10.

As illustrated in FIG. 10, the third exemplary signal generating circuit 701*a* has substantially the same construction as that of the signal generating circuit 701 of FIG. 8, except for the capacitors C11 to C14. Therefore, further detailed description of like elements, denoted by like reference numerals, is omitted for brevity.

The capacitor C11 is formed between the transistor Tr4 and the low voltage AVSS. The capacitor C12 is coupled between the transistor Tr5 and the high voltage AVDD. The capacitor C13 is coupled between the transistor Tr7 and the low voltage AVSS. The capacitor C14 is coupled between the transistor Tr6 and the high voltage AVDD.

The capacitors C11 to C14 function stabilize the voltages applied to the control terminals of the transistors Tr5, Tr4, Tr7, and Tr6 connected thereto. That is, when the turn-on voltages are applied to the control terminals of the transistors Tr5, Tr4, Tr7, and Tr6, the capacitors C11 to C14 are charged, so that the turn-on voltages applied to the control terminals of the transistors Tr5, Tr4, Tr7, and Tr6 are blocked. However, the signals of the control terminals of the transistors Tr5, Tr4, Tr7, and Tr6 are sustained at a constant level due to the voltages charged in the capacitors C11 to C14.

The construction of an exemplary embodiment of a thin film transistor array panel in accordance with the present invention for use in the exemplary LCD is described in detail below with reference to the accompanying drawings.

Figure 11:
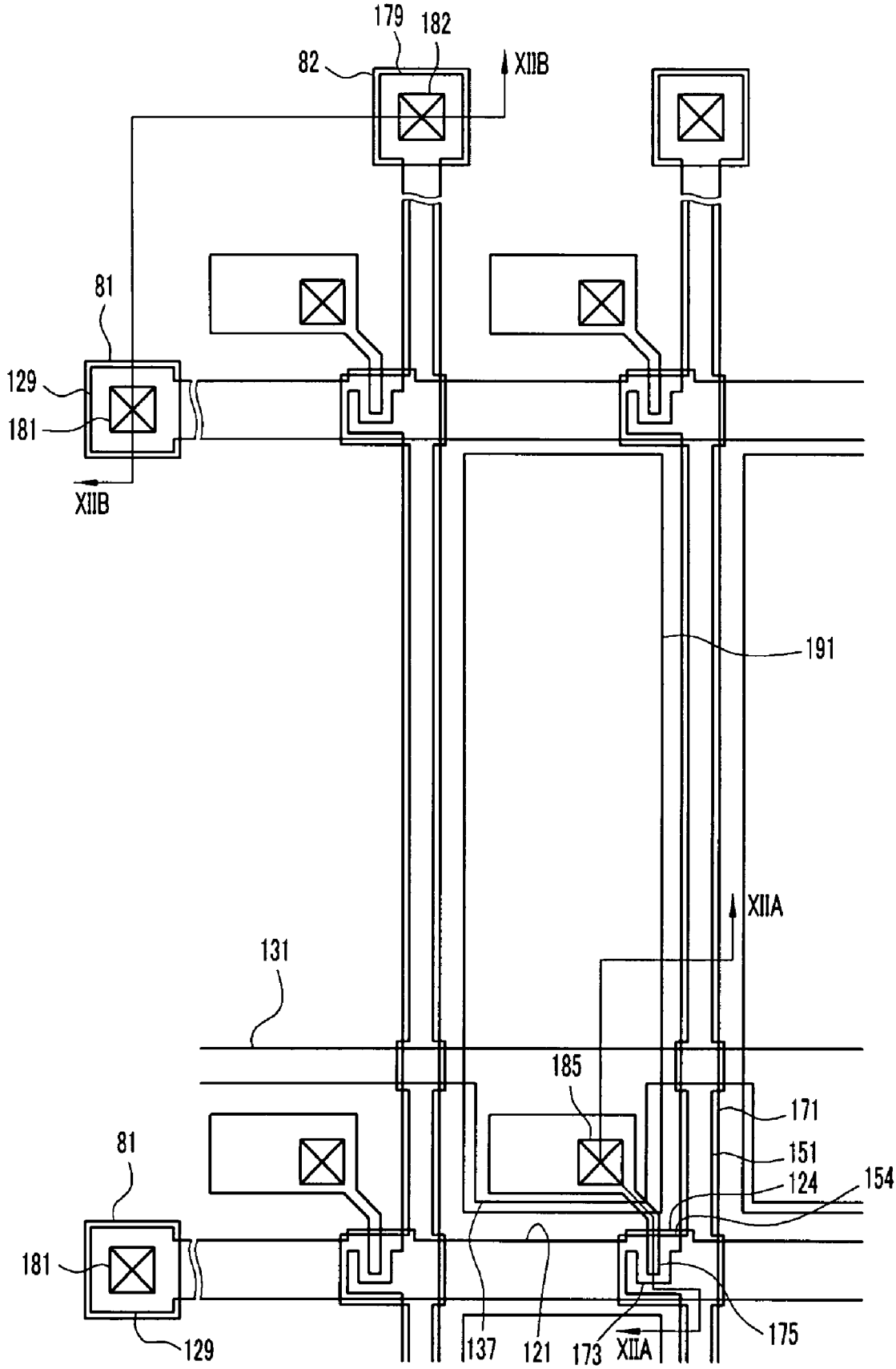
FIG. 11 is a partial top plan view of an exemplary embodiment of a thin film transistor (TFT) array panel of an LCD in accordance with the present invention, showing a single pixel area thereof.
Figure 12A:
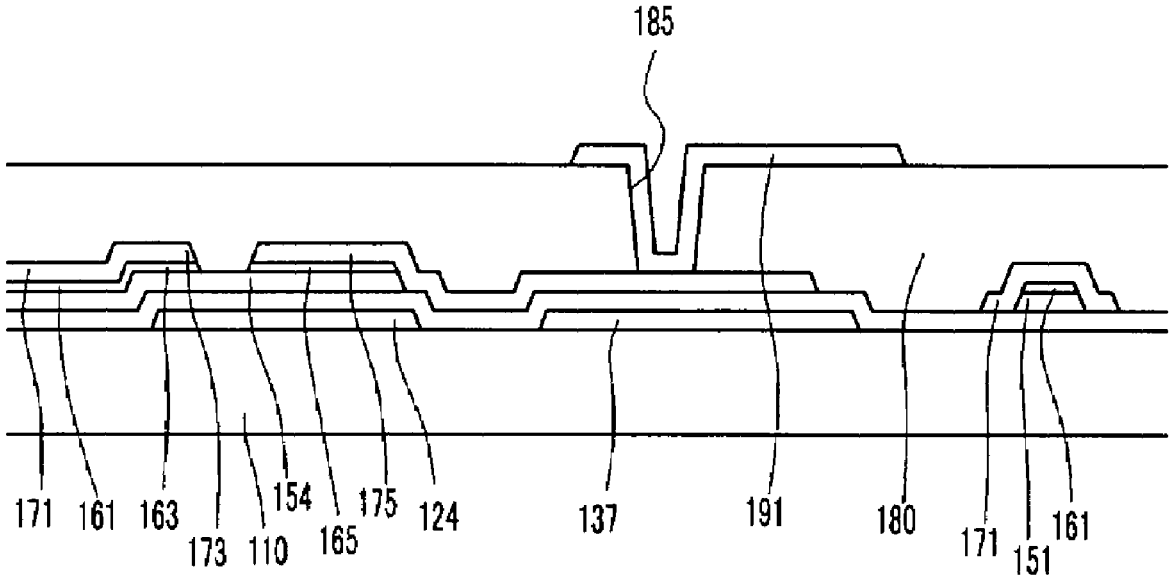
FIGS. 12A and 12B are partial cross-sectional views of the exemplary TFT array panel of FIG. 11, as respectively seen along the lines of the sections XIIA-XIIA and XIIB-XIIB taken therein.
Figure 12B:
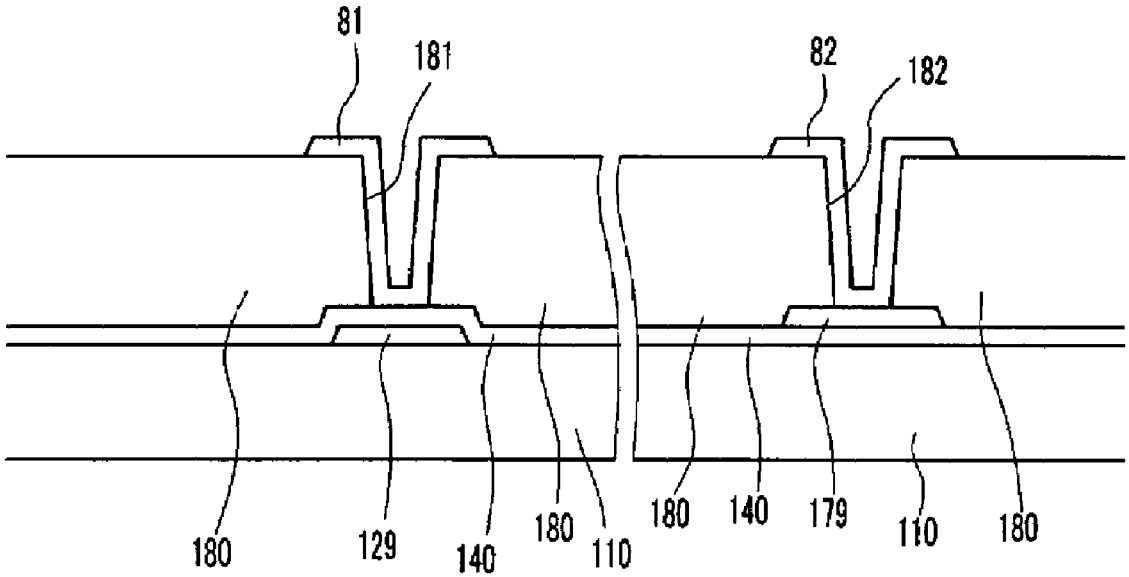

A first exemplary embodiment of the thin film transistor (TFT) array panel is described with reference to FIGS. 11 to 12B, wherein FIG. 11 is a partial top plan view of the exemplary array panel, showing a single pixel area thereof, and FIGS. 12A and 12B are partial cross-sectional views of the exemplary array panel, as respectively seen along the lines of the sections XIIA-XIIA and XIIB-XIIB taken in FIG. 11.

A plurality of gate lines 121 and a plurality of storage electrode lines 131 are disposed on an insulating substrate 110 made of a transparent glass or plastic. The gate lines 121 extend generally in a horizontal direction in the figure and function to transmit the gate signals. The gate lines 121 include a plurality of gate electrodes 124 that protrude downwardly and end portions 129 that have wide areas for connection to other layers or an external driving circuit.

A gate driving circuit (not illustrated) that generates the gate signals may be mounted on a flexible printed circuit film (not illustrated) that is attached on the substrate 110, or alternatively, the gate driving circuit may mount directly on the substrate 110, or it may otherwise be integrated into the substrate 110. In an embodiment in which the gate driving circuit is integrated into the substrate 110, the gate lines 121 may be connected directly to the gate driving circuit.

Each of the storage electrode lines 131 extends generally in the horizontal direction and includes a plurality of enlarged portions 137 with widths that expand downwardly. Each of the storage electrode lines 131 may further include end portions that have wide areas for connection to other layers or to an external driving circuit. However, the shape and arrangement of the storage electrode lines 131 may be modified in various other ways.

Alternate ones of the storage electrode line 131 are applied with selected voltages of the high level voltage V+ of about 5V and the low level voltage V− of about 0V in units of a frame.

A signal generating circuit (not illustrated) that generates the storage signals may be mounted on a flexible printed circuit film (not illustrated) that mounts on the substrate 110, or alternatively, the signal generating circuit may be directly mounted on the substrate 110, or otherwise be integrated into the substrate 110. In an embodiment in which the signal generating circuit is integrated into the substrate 110, the storage electrode line 131 may extend so as to connect directly to the signal generating circuit.

The gate lines 121 and the storage electrode lines 131 may include a metal, such as aluminum (Al), silver (Ag), copper (Cu), molybdenum (Mo), chromium (Cr), tantalum (Ta), or titanium (Ti). Alternatively, the gate lines 121 and the storage electrode lines 131 may have a multi-layered structure including two conductive layers (not layers) having different physical properties. One of the two conductive layers, for example, may include a metal, such as aluminum (Al), silver (Ag), copper (Cu), molybdenum (Mo), chromium (Cr), tantalum (Ta), or titanium (Ti) in order to reduce signal delay or voltage drop. The other conductive layer may include a material having good physical, chemical, and electrical contact characteristics with other materials, particularly with ITO (indium tin oxide) and IZO (indium zinc oxide), such as a molybdenum-containing metal, chromium, titanium, and tantalum. Preferred examples of the combination may include a combination of a lower chromium layer and an upper aluminum alloy layer, and a combination of a lower molybdenum alloy layer and an upper aluminum layer. However, the gate lines 121 and the storage electrode lines 131 may be made of various other metals and conductive materials.

Preferably, the side surfaces of the gate lines 121 and the storage electrode lines 131 are slanted with respect to the surface of the substrate 110 upon which they are disposed, with a slant angle of from about 30° to about 80°.

A gate insulating layer 140 made of a silicon nitride SiNx, a silicon oxide SiOx or the like is formed on the gate lines 121 and the storage electrode lines 131.

A plurality of semiconductor stripes 151 made of hydrogenated amorphous silicon (a-Si) or polysilicon are formed at selected locations on the gate insulating film 140. The semiconductor stripes 151 extend generally in the vertical direction, and include a plurality of projections 154 that extend toward the gate electrodes 124. In addition, the widths of the semiconductor stripes 151 are expanded at regions near the gate lines 121 and the storage electrode lines 131 to cover wide areas thereof.

A plurality of line-shaped and island-shaped ohmic contacts 161 and 165 are formed on the semiconductor stripes 151. The ohmic contacts 161 and 165 may include silicide or n+ hydrogenated amorphous silicon that is heavily doped with n-type impurities, such as phosphorus (P). The line-shaped ohmic contacts 161 include a plurality of projections 163. Associated pairs of the projections 163 and an island-shaped ohmic contact 165 are disposed on a protrusion 154 of an associated semiconductor stripe 151.

Side surfaces of the semiconductor stripes 151 and the ohmic contacts 161 and 165 are also preferably slanted with respect to the surface of the substrate 100, at a slant angle of from about 30° to about 80°.

A plurality of data lines 171 and a plurality of drain electrodes 175 are formed on the ohmic contacts 161 and 165 and the gate insulating film 140.

The data lines 171 transmit respective data signals and extend generally in the vertical direction in the figure to intersect the gate lines 121 and the storage electrode lines 131. The data lines 171 include a plurality of source electrodes 173 that protrude toward the gate electrodes 124, and end portions 179 that have wide areas for connection to other layers or to external driving circuits. A data driving circuit (not illustrated) that generates the data signals may be mounted on a flexible printed circuit film (not illustrated) that mounts on the substrate 110, or alternatively, may be mounted directly on the substrate 110, or may otherwise be integrated into the substrate 110. In an embodiment in which the data driving circuit is integrated into the substrate 110, the data lines 171 may extend to connect directly to the data driving circuit.

The drain electrode 175 is separated from the data line 171 and faces a source electrode 173 with the gate electrode 124 interposed therebetween. Each of the drain electrodes 175 includes a wide end and a bar-shaped end. The wide end overlaps an enlarged portion of the storage electrode line 131, and the bar-shaped end is partially surrounded by the curved source electrode 173.

One gate electrode 124, one source electrode 173, and one drain electrode 175, together with one protrusion 154 of one semiconductor stripe, constitute one thin film transistor (TFT). The channel of the thin film transistor is formed in the protrusion 154 between the source electrode 173 and the drain electrode 175.

Preferably, the data lines 171 and the drain electrodes 175 are made of molybdenum (Mo), a refractory metal, such as chromium (Cr), tantalum (Ta), and titanium (Ti), or a respective alloy thereof. The data lines 171 and the drain electrodes 175 may have a multi-layered structure, including a refractory metal layer (not illustrated) and a low-resistivity conductive layer (not illustrated). Examples of the multilayered structure include a double-layered structure of a lower chromium (or molybdenum alloy) layer and an upper aluminum alloy layer, and a triple-layered structure having a lower molybdenum alloy layer, an intermediate aluminum alloy layer, and an upper molybdenum alloy layer. However, the data line 171 and drain electrode 175 may be made of various other metals and conductive materials instead of those listed above.

Preferably, the side surfaces of the data lines 171 and the drain electrodes 175 are also slanted with respect to the surface of the substrate 110, with a slant angle of from about 30° to about 80°.

The ohmic contacts 161 and 165 are interposed only between the underlying semiconductor stripes 151 and the overlying data lines 171 and the drain electrodes 175, and function to reduce the respective contact resistances therebetween. Although the widths of the semiconductor stripes 151 are smaller than those of the data lines 171 in most regions, the widths of the portions at which the gate lines 121 and the storage electrode lines 121 intersect each other are enlarged, as described above. The semiconductor stripes 151 have exposed portions that are not covered by the data lines 171 and the drain electrodes 175, such as the portions disposed between the source electrodes 173 and the drain electrodes 175.

A passivation layer 180 is formed on the data line 171, the drain electrode 175, and the exposed portions of the semiconductor stripes 151. The passivation layer 180 may be made of an organic or an inorganic insulating material, and may have a planarized upper surface. Examples of the insulating material include silicon nitride and silicon oxide. The organic insulating material may have photosensitivity, and the dielectric constant thereof is preferably about 4.0 or less. Alternatively, the passivation layer 180 may incorporate a double-layered structure of a lower inorganic layer and an upper organic layer in order to provide the superior insulating property of an organic layer and a robust protection of the exposed portions of the semiconductor stripes 151.

A plurality of contact holes 182 and 185 that expose end portions 179 of the data lines 171 and the drain electrodes 175, respectively, are formed on the passivation layer 180. A plurality of contact holes 181 that expose end portions 129 of the gate lines 121 are formed on the passivation layer 180 and the gate insulating layer 140.

A plurality of pixel electrodes 191 and a plurality of contact assistants 81 and 82 are formed on the passivation layer 180. The pixel electrodes 191 may be made of a transparent conductive material, such as ITO and IZO, or a reflective metal, such as aluminum, silver, and chromium, or an alloy thereof.

The pixel electrode 191 is physically and electrically connected to the drain electrode 175 through the contact hole 185 and receives a data voltage applied by the drain electrode 175. The pixel electrode 191 that is applied with the data voltage, together with a common electrode (not illustrated) that is disposed in the other display panel (not illustrated) and applied with a common voltage, generates an electric field. The electric field determines the alignment of the liquid crystal molecules of the liquid crystal layer (not illustrated) disposed between the two electrodes. The polarization of light passing through the liquid crystal layer varies according to the alignment of the liquid crystal molecules. The pixel electrode 191 and the common electrode constitute a capacitor (referred to herein as a liquid crystal capacitor) that sustains the applied voltage after the thin film transistor turns off.

A capacitor formed by overlapping the pixel electrode 191 and the drain electrode 175 that is electrically connected to the pixel electrode 191 with the storage electrode line 131 is called a storage capacitor, and it enhances the voltage storage capacity of the liquid crystal capacitor. Due to the enlarged portion 137 of the storage electrode line 131, the area of overlap is increased, so that the electrostatic capacitance of the storage capacitor is enhanced.

The contact assistants 81 and 82 are connected to the end portions 129 of the gate lines 121 and the end portions 179 of the data lines 171 through the contact holes 181 and 182, respectively. Therefore, the contact assistants 81 and 82 function to enhance the adhesiveness of the end portions 129 and 179 of the gate and data lines 121 and 171 to the external devices and protecting the end portions 129 and 179.

Figure 13:
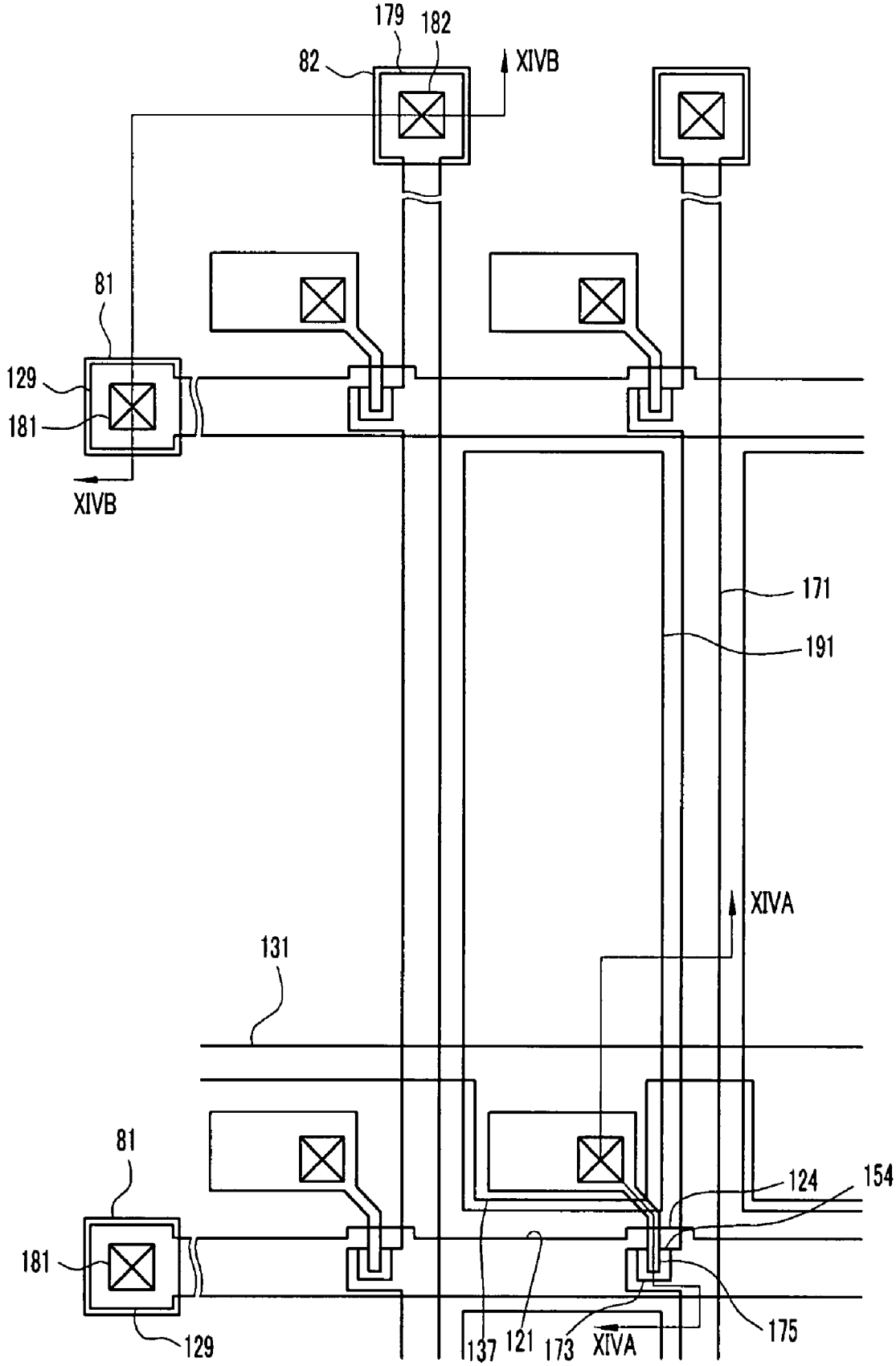
FIG. 13 is a partial top plan view of another exemplary embodiment of a TFT array panel of an LCD in accordance with the present invention, showing a single pixel area thereof; and, FIGS. 14A and 14B are partial cross-sectional views of the TFT array panel of FIG. 13, as respectively seen along the lines of the sections XIVA-XIVA and XIVA-XIVA taken therein.
Figure 14A:
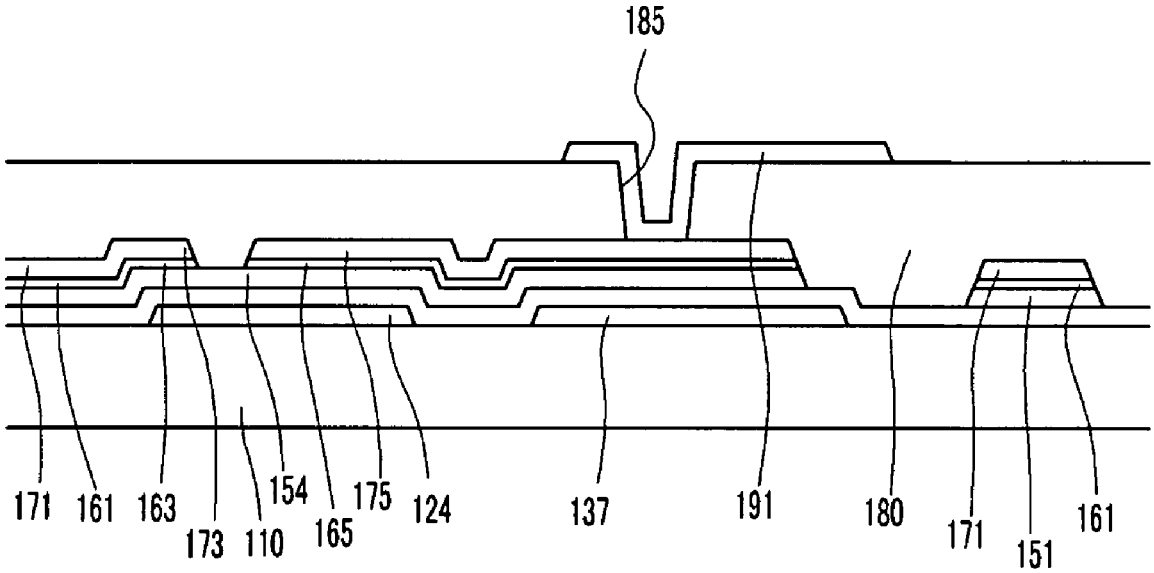
Figure 14B:
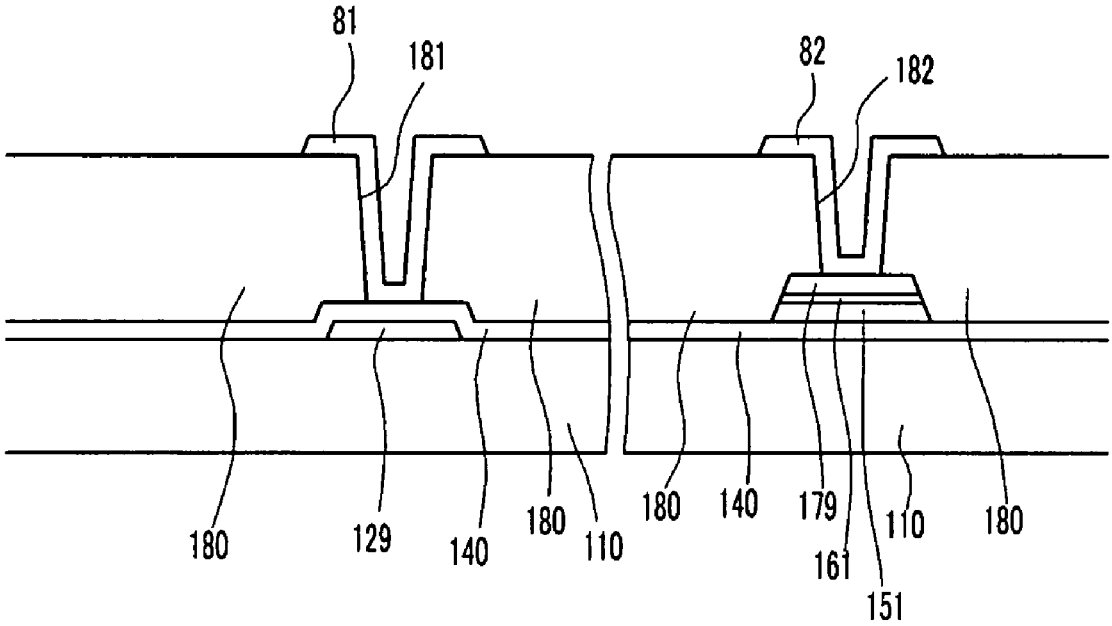

Another exemplary embodiment of a thin film transistor array panel in accordance with the present invention is described below with reference to FIGS. 13 to 14B, wherein FIG. 13 is a partial top plan view of the exemplary array panel and FIGS. 14A and 14B are partial cross-sectional views of the exemplary array panel, as respectively seen along the lines of the sections XIVA-XIVA and XIVA-XIVA taken in FIG. 13.

As may be seen in FIG. 13, the construction of the exemplary TFT array panel is substantially the same as that shown in FIGS. 11 to 12B. A plurality of gate lines 121 having gate electrodes 124 and end portions 129 and a plurality of storage electrode lines 131 having a plurality of enlarged portions 137 are disposed on the substrate 110. A gate insulating layer 140, a plurality of semiconductor stripes 151 having projections 154, a plurality of line-shaped ohmic contacts 161 having projections 163, and a plurality of island-shaped ohmic contacts 165 are sequentially disposed thereon in the foregoing order. Source electrodes 173, a plurality of data lines 171 having end portions 179, and a plurality of drain electrodes 175 are disposed on the ohmic contacts 161 and 165. A passivation layer 180 is disposed thereon. A plurality of contact holes 181, 182, and 185 are formed in the passivation layer 180 and the gate insulating layer 140. A plurality of pixel electrodes 191 and a plurality of contact assistants 81 and 82 are disposed thereon.

Unlike the exemplary TFT array panel shown in FIGS. 11 to 12B, in this exemplary array panel, the semiconductor stripes 151 have substantially the same planar shape as those of the data line 171, the drain electrode 175, and the underlying ohmic contacts 161 and 165, except for the projections 154 at which the thin film transistors are disposed. That is, the semiconductor stripes 151 have unexposed portions disposed below the data lines 171, the drain electrodes 175, and underlying ohmic contacts 161 and 165, and exposed portions that are not uncovered between the source electrodes 173 and the drain electrode 175.

In accordance with the exemplary embodiments disclosed herein, after the common voltage is fixed at a selected voltage, the storage signals, the levels of which are changed within a selected period of time, are applied to the storage electrode lines. Storage signals having different voltage are then applied to the adjacent storage electrode lines. As a result, the range of the pixel electrode voltage is widened, and accordingly, the range of the pixel voltage is also widened. Since the range of voltage for representing grays is widened, the image quality of the display is correspondingly improved.

In the case in which data voltages having the same range are applied, a relatively wide range of the pixel voltage can be generated in comparison to the case in which a constant storage signal is applied. Therefore, power consumption of the display is reduced. In addition, the common voltage is fixed at a constant value, so that the power consumption of the display is further reduced.

In addition, since the range of the pixel electrode voltage before the completion of the charging operation of the liquid crystal is wider than the range of the pixel electrode voltage after the completion of the charging operation, a voltage that is higher or lower than the target voltage is applied at the initial time of driving the liquid crystal, and the response speed of the liquid crystal material is thereby improved.

Further, the two output transistors of the signal generating circuits are alternately operated during a time period of about 1H, and the storage signal applied through the storage electrode line is sustained until the next frame. Therefore, the reliability of the transistor operation for sustaining the storage signal is improved, and the durability of the transistors is also improved. Accordingly, the supply of a stable storage signal is made possible.

While this invention has been described and illustrated in connection with what is presently considered to be practical exemplary embodiments thereof, it should be understood by those of ordinary skill in the art that the invention is not limited to the disclosed embodiments, but, on the contrary, is intended to cover various modifications and equivalent arrangements included within the spirit and scope of the appended claims.

What is claimed is:

1. A display device configured to display images in a plurality of frames, the display device comprising:

a plurality of gate lines adapted to transmit a plurality of gate signals;

a plurality of data lines adapted to transmit a plurality of data voltages;

a plurality of storage electrode lines adapted to transmit a plurality of storage signals based on the gate signals;

a plurality of pixels arranged in a matrix having a plurality of rows, wherein each pixel comprises a switching element connected to one of the gate lines and one of the data lines, a liquid crystal capacitor connected to the switching element and a common voltage, and a storage capacitor connected to the switching element and one of the storage electrode lines; and, a plurality of signal generating circuits connected to the storage electrode lines, wherein each of the signal generating circuits is adapted to apply a storage signal having a first or second voltage to an associated one of the storage electrode lines in response to a gate-on voltage of a first gate signal and a first control signal immediately after the liquid crystal capacitors and storage capacitors of an associated row of pixels have been charged by the data voltages, adapted to maintain the voltage of the storage signal for a predetermined time period in response to a gate-on voltage of a second gate signal and second and third control signals, and adapted to maintain the voltage of the storage signal in alternative response to one of the second control signal and the third control signal every predetermined period after the second gate signal outputs a gate-off voltage.

2. The display device of claim 1, wherein the storage signals applied to adjacent storage electrode lines have different voltage levels from each other.

3. The display device of claim 1, wherein the storage signal applied to the same storage electrode line has a voltage level that is inverted every display frame.

4. The display device of claim 1, wherein the common voltage is a fixed voltage.

5. The display device of claim 1, wherein the predetermined period is about one horizontal period (1H).

6. The display device of claim 1, wherein a waveform of the first control signal is the same as that of the third control signal.

7. The display device of claim 6, wherein a waveform of the second control signal is opposite to that of the third control signal.

8. The display device of claim 6, wherein each of the first, second, and third control signals has a first voltage level and a second voltage level higher than the first voltage level, and alternates between the first and second voltage levels during a time period of about 1H.

9. The display device of claim 8, wherein an application time between the gate-on voltage of the first gate signal and the gate-on voltage of the second gate signal is about 1H difference.

10. The display device of claim 8, wherein each of the signal generating circuits comprises a first transistor having a control terminal connected to one of the gate lines, an input terminal connected to the first control signal, and an output terminal connected to one of the storage electrode lines.

11. The display device of claim 10, wherein each of the signal generating circuits further comprises a second transistor having a control terminal connected to the gate line and an input terminal connected to the second control signal, and a third transistor having a control terminal connected to the gate line and an input terminal connected to the third control signal.

12. The display device of claim 11, wherein each of the signal generating circuits further comprises a fourth transistor having a control terminal connected to another of the gate lines and an input terminal connected to the second control signal, and a fifth transistor having a control terminal connected to the another gate line and an input terminal connected to the third control signal.

13. The display device of claim 12, wherein each of the signal generating circuits further comprises:

a first capacitor having a first terminal connected to an output terminal of the second transistor and a second terminal connected to the third control signal;

a second capacitor having a first terminal connected to an output terminal of the third transistor and a second terminal connected to the second control signal;

a sixth transistor having a control terminal connected to the first terminal of the first capacitor, an output terminal connected to the storage electrode line, and an input terminal connected to the first driving voltage; and, a seventh transistor having a control terminal connected to the first terminal of the second capacitor, an input terminal connected to the second driving voltage, and an output terminal connected to the storage electrode line.

14. The display device of claim 13, wherein each of the signal generating circuits further comprises:

a third capacitor having a first terminal connected to an output terminal of the fourth transistor and a second terminal connected to the third control signal;

a fourth capacitor having a first terminal connected to an output terminal of the fifth transistor and a second terminal connected to the second control signal;

an eighth transistor having a control terminal connected to the first terminal of the third capacitor, an input terminal connected to the second driving voltage, and an output terminal connected to the storage electrode line; and, a ninth transistor having a control terminal connected to the first terminal of the fourth capacitor, an input terminal connected to the storage electrode line, and an output terminal connected to the first driving voltage.

15. The display device of claim 14, wherein the first driving voltage is lower than the second driving voltage.

16. The display device of claim 15, wherein the first driving voltage is about 0V.

17. The display device of claim 13, wherein the second driving voltage is about 5V.

18. The display device of claim 15, wherein the second voltage level is higher than the second driving voltage.

19. The display device of claim 18, wherein the second voltage level is about 15V.

20. The display device of claim 14, further comprising:

a fifth capacitor connected between the control terminal of the sixth transistor and the first driving voltage;

a sixth capacitor connected between the control terminal of the seventh transistor and the second driving voltage;

a seventh capacitor connected between the control terminal of the eighth transistor and the second driving voltage; and, an eighth capacitor connected between the control terminal of the ninth transistor and the first driving voltage.

* * * * *